United States Patent [19]

Sakamoto et al.

[11] Patent Number: 5,008,711

[45] Date of Patent: Apr. 16, 1991

[54] IMAGE FORMING APPARATUS

[75] Inventors: Koji Sakamoto, Tokyo; Misao Tanzawa, Kawasaki; Nobuo Iwata, Sagamihara; Hisao Murayama, Kawasaki; Susumu Takahashi; Kenya Komada, both of Yokohama, all of Japan

[73] Assignee: Ricoh Company, Ltd., Tokyo, Japan

[21] Appl. No.: 183,707

[22] Filed: Apr. 19, 1988

[30] Foreign Application Priority Data

| | | | |
|---|---|---|---|
| Apr. 23, 1987 | [JP] | Japan | 62-98613 |
| May 20, 1987 | [JP] | Japan | 62-121191 |
| Oct. 16, 1987 | [JP] | Japan | 62-259785 |

[51] Int. Cl.[5] ..... G03G 15/00

[52] U.S. Cl. ..... 355/206; 355/211

[58] Field of Search ..... 355/3 R, 3 DR, 3 DD, 355/15, 14 R, 206, 211, 298

[56] References Cited

U.S. PATENT DOCUMENTS

| | | | |
|---|---|---|---|
| 1,419,174 | 6/1922 | Metzner et al. | 74/209 |
| 1,870,421 | 8/1932 | Prout | 74/209 |
| 2,935,879 | 5/1960 | Morrison et al. | 74/209 |
| 3,949,617 | 4/1976 | Baldoni | 74/209 |
| 4,114,998 | 9/1978 | Shimizu et al. | 355/211 X |
| 4,273,000 | 6/1981 | Schmid | 74/209 |
| 4,478,507 | 10/1984 | Miyoshi et al. | 355/211 |
| 4,527,883 | 7/1985 | Kamiyama | 355/211 |
| 4,674,858 | 6/1987 | Nagayama | 355/211 |
| 4,708,455 | 11/1987 | Kubota et al. | 355/211 |
| 4,791,454 | 12/1988 | Takahashi et al. | 355/15 |

FOREIGN PATENT DOCUMENTS

| | | | |
|---|---|---|---|
| 54-29643 | 5/1979 | Japan | 355/14 R |
| 0136670 | 8/1982 | Japan | 355/259 |

*Primary Examiner*—Joan H. Pendegrass

*Attorney, Agent, or Firm*—Oblon, Spivak, McClelland, Maier & Neustadt

[57] ABSTRACT

An image forming apparatus of the type including a plurality of process means for developing an electrostatic latent image provided on an image carrier to produce a visible image, transferring the visible image to a transfer material, and cleaning the image carrier after the image transfer. The image carrier and at least one image forming unit are individually removably mounted on a body of the apparatus. A first and a second sensor are provided for sensing, respectively, the end of the life of the image forming unit and that of the image carrier. Even when the end of the life of the image carrier is sensed, an indication for urging a person to replace the image forming unit being used is not produced if the life of the image forming unit has not expired, allowing the apparatus to be continuously used. It is not until the end of the life of the image forming unit is sensed next that an indication for urging a person to replace both of the image carrier and the image forming unit is produced.

9 Claims, 17 Drawing Sheets

IMAGE FORMING APPARATUS

BACKGROUND OF THE INVENTION

The present invention relates to an image forming apparatus of the type including a plurality of process means for forming a visible image on an image carrier which is adapted to carry an electrophotostatic latent image, transferring the visible image to a transfer material, and cleaning the image carrier after the image transfer. More particularly, the present invention is concerned with an electrophotographic copier, printer, facsimile apparatus and other image forming apparatuses having at least one image forming unit and an image carrier which are individually removably mounted on the apparatus, a unit life sensor for sensing the end of the life of the image forming unit, and an image carrier life sensor for sensing the end of the life of the image carrier.

An image forming apparatus of the type described has been implemented as a printer, facsimile apparatus or the like and proposed in a variety of configurations, as disclosed in Japanese Laid-Open Patent Publication (Kokai) No. 61-118770 by way of example. In this type of apparatus, at least one of various process means such as a charging device, exposing device, developing device, transferring device, cleaning device and discharging device is constructed into an image forming unit which is independent of an image carrier. This independent unit and the image carrier are individually removably mounted on the apparatus, so that any one of them may be replaced with a new one when its life expires. Also known in the art is an image forming apparatus in which the image carrier is combined with at least one of the process means to constitute an image forming unit which is removable from the the apparatus. In this kind of apparatus, when the life of the process means or that of the image carrier of the image forming unit expires, the entire image forming unit is replaced. This scheme, however, tends to force a user to bear an excessive burden in the economic aspect. Specifically, in parallel with the recent progress in technology, the life of, for example, the image carrier which is constituted by a photoconductive element is becoming longer than those of the developing device, cleaning device and other process means. In the case that such an image carrier and process means such as the developing device or cleaning device are constructed into an image forming unit, when the life of the process unit expires, even the image carrier which is still usable has to be discarded simply wastefully. The first-described type of apparatus in which the image forming unit and the image carrier are independent of each other is advantageous in that the image forming unit can be replaced independently of the image carrier and, therefore, the image carrier can be used til the end of its life.

As will be understood from the above, allowing the image carrier and the image forming unit to be replaced independently of each other is desirable from the economical standpoint. However, replacing them independently of each other results in the need for frequent replacement which would be troublesome for an operator.

SUMMARY OF THE INVENTION

It is therefore an object of the present invention to provide an image forming apparatus capable of reducing the frequency of replacement of an image carrier and an image forming unit as far as possible.

It is another object of the present invention to provide a generally improved image forming apparatus.

In accordance with the present invention, there is provided an image forming apparatus which includes a body, an image carrier removably mounted on the body for carrying an electrostatic latent image thereon, and a plurality of process means for developing the latent image provided on the image carrier to produce a visible image, transferring the visible image to a transfer material, and cleaning the image carrier after the visible image has been transferred. The apparatus comprises at least one image forming unit having at least one of the process means and removably mounted on the body, first sensor means for sensing the end of the life of the image forming unit, second sensor means for sensing the end of the life of the image carrier, first display means for urging a person to replace the image forming unit when the first sensor means senses the end of the life of the image forming unit, and second display means for urging a person to replace the image forming unit and image carrier when the first sensor means senses the end of the life of the image forming unit after the second sensor means has sensed the end of the life of image carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the present invention will be described with reference to the accompanying drawings.

FIRST EMBODIMENT

Figure 1:
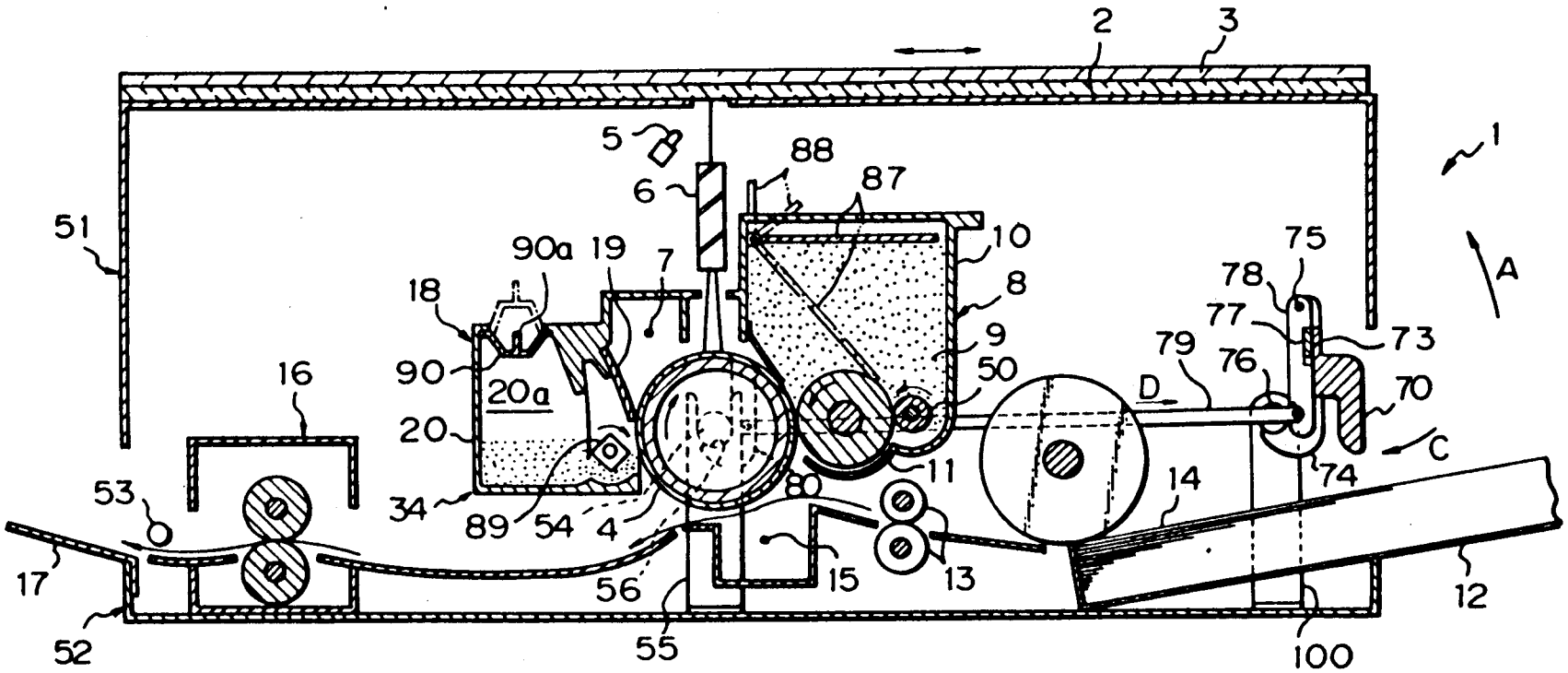
FIG. 1 is a vertical section of an electrophotographic copier which is representative of a first embodiment of the present invention.

Referring to FIG. 1, a first embodiment of the present invention is shown which is applied to an electrophotographic copier. As shown, a glass platen 2 is supported in an upper portion of a copier body 1 in such a manner as to be movable in a horizontal reciprocating motion. An original document, not shown, is laid on the glass platen 2 and pressed from the above by a cover plate 3. In the condition shown in FIG. 1, a photoconductive element 4 in the form of a drum is rotatably supported in the copier body 1 to serve as an image carrier. During operation of the copier, the glass platen 2 is horizontally moved while, at the same time, the document on the glass platen 2 is illuminated by a light source 5. Light reflected by the document is focused by a converging light conducting device 6 onto the surface of the drum 4 which is rotated clockwise by a driver, not shown, thereby exposing the drum 4 imagewise. Since the drum 4 is uniformly charged to a predetermined polarity by a charger 7 beforehand, a latent image is electrostatically formed on the drum 4 by the above exposure. When the latent image reaches a developing device 8, it is developed by toner to become a toner image. The developing device 8 includes a developing casing 10 in which toner 9 is stored, a developing roller 11 for carrying the toner on its periphery to transport it toward the drum 4, and a toner supply roller 50 for supplying the toner 9 to the developing roller 11. The toner on the developing roller 11 is electrostatically transferred to the drum 4 to develop the latent image. The developing roller and toner supply roller 50 are individually rotatably supported by the casing 10 and driven in a rotary motion by a driver, not shown. If desired, a two-component developer which contains carrier in addition to the toner 9 may be used.

A transfer material 14 which is implemented as a paper 14 is fed from a cassette 12 which is removably mounted in the copier body 1. At a predetermined timing, the paper 14 is driven by a register roller pair 13 toward the surface of the drum 4. A transferring device 15 in the form of a transfer charger transfers the toner image carried on the drum 4 to the paper 14. After the image transfer, the paper 14 is separated from the drum 14, then fed to a fixing device 16 to fix the toner image, and then discharged to a tray 17. The surface of the drum 4 after the image transfer is effected by a discharging device, not shown, for dissipating the charge. That part of the toner remaining on the drum 4 is scraped off by a cleaning member of a cleaning device 18 which in this embodiment is constituted by a cleaning blade 19 that abuts against the drum 4. This part of toner collected is returned to a toner containing section 20*a* of a cleaning casing 20.

The copier body 1 is divided into an upper structural assembly 51 and a lower structural assembly 52. The upper assembly 51 is connected to the lower assembly 52 to be rotatable about a pin 53 in a direction indicated by an arrow A. While the copier is operated, the upper assembly 51 is loaded on the lower assembly 52 as shown in FIG. 1.

In the illustrative embodiment, the developing casing 10 and cleaning casing 20 are constructed integrally with each other so that the developing device 8 and cleaning device 18 constitute an image forming unit 34. Further, the charger 7 is also associated with the cleaning casing 20 and therefore forms a part of the image forming unit 34. If desired, the cleaning casing 20 and developing casing 10 may be connected together to be individually rotatable, thereby joining the devices 8 and 18 integrally with each other.

Figure 2:
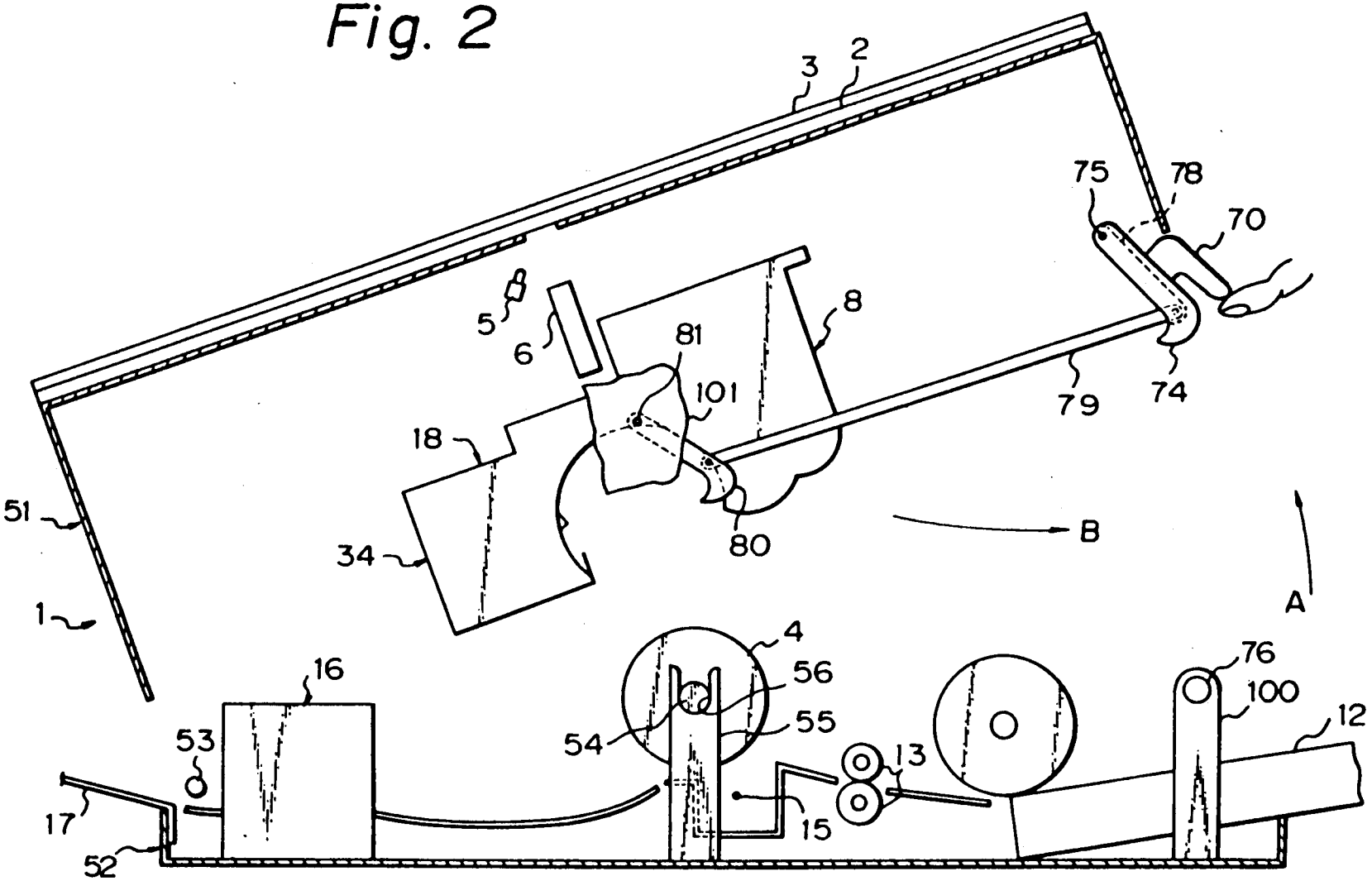
FIG. 2 is a section of the copier which is taken at a position closer to the front than FIG. 1, showing a condition wherein an upper structural assembly is raised with a photoconductive element left in a lower structural body.
Figure 3:
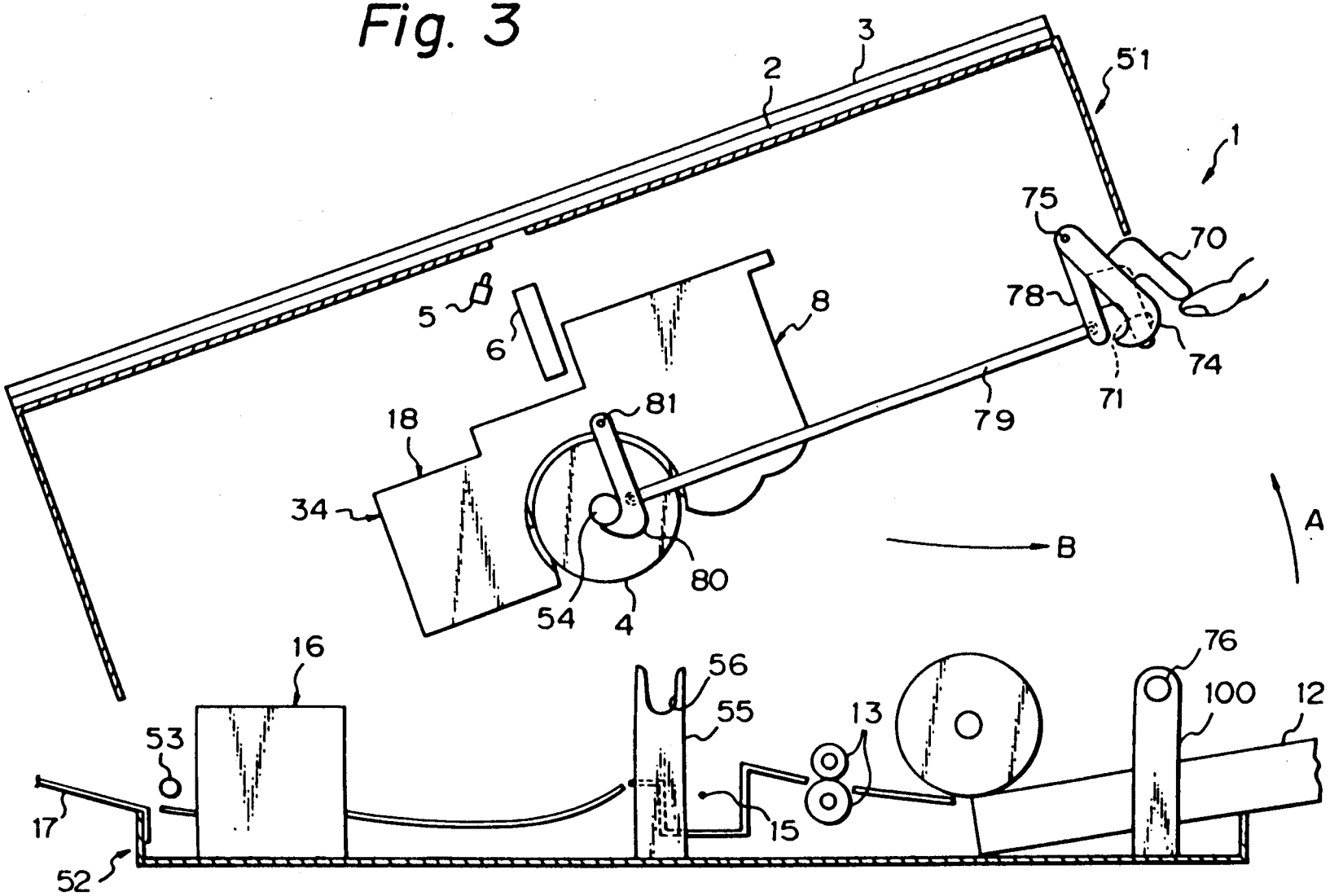
FIG. 3 is a view similar to FIG. 2, showing the upper assembly which is raised together with the photoconductive element.

As shown in FIGS. 2 and 3, a front and a rear shaft 54 extend from axially opposite ends of the drum 4 and each is rotatably and removably supported by a bearing portion 56 of a drum support member 55, which is rigidly mounted on a bottom plate of the lower assembly 52. It is to be noted that the words "front" and "rear" respectively refer to the surface side and the back side as viewed in a direction perpendicular to the sheets of FIGS. 1 through 3. While FIG. 1 shows only the support member 55 for supporting the rear shaft 54, FIGS. 2 and 3 show only the support member 55 for supporting the front shaft 54. The image forming unit 34 is removably mounted in the upper assembly 51. In this manner, both the image forming unit 34 and the drum 4 are removably mounted in the copier body 1 and, in addition, they are movable into engagement with each other as shown in FIG. 1 and out of engagement as shown in FIG. 2.

The other structural elements previously stated are selectively mounted in the upper assembly 51 and lower assembly 52, as understood by comparing FIGS. 1 and 2.

As the copier repeats the previously mentioned copying cycle, the toner 9 stored in the developing casing 10 is consumed. When the amount of toner in the casing 10 is reduced beyond a predetermined amount, the density of toner image to be provided on the drum 4 is lowered to in turn impair the quality of a reproduction. This is the end of the life of the developing device 8. Usually, however, the life of a developing device is considered to expire during the interval between the time or slightly before the time when the degradation of an image begins due to shortage of toner or slightly and the time when the developing casing 10 becomes empty. On the other hand, the toner containing section 20*a* of the cleaning casing 20 is sequentially filled with the toner collected until it becomes unable to accommodate any more toner. Therefore, the life of the cleaning device 18 is considered to expire when or slightly before the cleaning casing 20 becomes full of toner. Further, the drum 4 is sequentially deteriorated due to aging resulting in the quality of toner image being impaired. This is the end of the life of the drum 4. The life of a drum, too, is regarded to expire when or somewhat before noticeable degradation of an image begins.

When it is decided that the life of the image forming unit 34, i.e., the life of the cleaning device 18 or that of the developing device 8 has ended, it is necessary to replace the unit 34 with another. Likewise, the drum 4 has to be replaced when its life expires. When such a condition is reached, the upper assembly 51 is manually raised away from the lower assembly 52, as indicated by the arrorw A in FIG. 2. The upper assembly 51 in turn raises the image forming unit 34 therewith. On the other hand, the drum 4 is left on the support members 55 in the lower assembly 52. After the image forming unit 34 and the drum 4 have been separated from each other as stated, the unit 34 is removed from the upper assembly 51 and pulled out, for example, in a direction indicated by an arrow B and, subsequently, a new image forming unit is loaded in the upper assembly 51. The drum 4 which is now uncovered and therefore accessible from the outside may be removed from the support members 55 for replacement purpose. After the replacement, the upper assembly 51 is returned to the position of FIG. 1 at which it is ready to perform a copying operation. The above procedure may also be effected when the developing device 8 should be replaced with another which stores toner of different color.

Advantageously, the developing device 8 and the cleaning device 18 are rotatably connected to each other as previously stated so that, when the image forming unit 34 is raised as shown in FIG. 2, lower parts of the devices 8 and 18 are urged toward each other by a spring until the opening therebetween is closed. This prevents toner from dropping when the unit 34 is moved into and out of the upper assembly 51.

FIG. 3 shows an embodiment in which the image forming unit 34 and drum 4 are raised together when the upper assembly 51 is rotated so that they may be replaced together. This arrangement will be described in detail later.

As stated above, since only the image forming unit 34 is replaceable with the drum 4 left in the copier body 1, it is needless to wastefully discard the drum 4 together with the developing unit 8 and cleaning unit 18 while the drum 4 is still usable. However, when the drum 4 and the image forming unit 34 are simply constructed to be replaceable independently of each other, the frequency of replacement of the unit 34 and drum 4 is increased forcing a person to perform troublesome manipulation frequently.

In light of the above, the illustrative embodiment is so constructed as to cause the image forming unit 34 to be replaced together with the drum 4 whenever the drum 4 is replaced, thereby eliminating wasteful replacement of the drum 4 only. Specifically, the frequency of replacement is reduced by matching the timing for replacing the drum 4 to that for replacing the image forming unit 34. The principle of such a construction will be described first.

Although not shown in FIG. 1, the copier includes a unit life sensor for sensing that either the developing device or the cleaning device 18, i.e., the image forming unit 34 has reached the end of its life, and an image carrier life or drum life sensor for sensing that the life of the drum 4 has expired. Specific constructions of these sensors will be described in detail later.

Figure 4A:
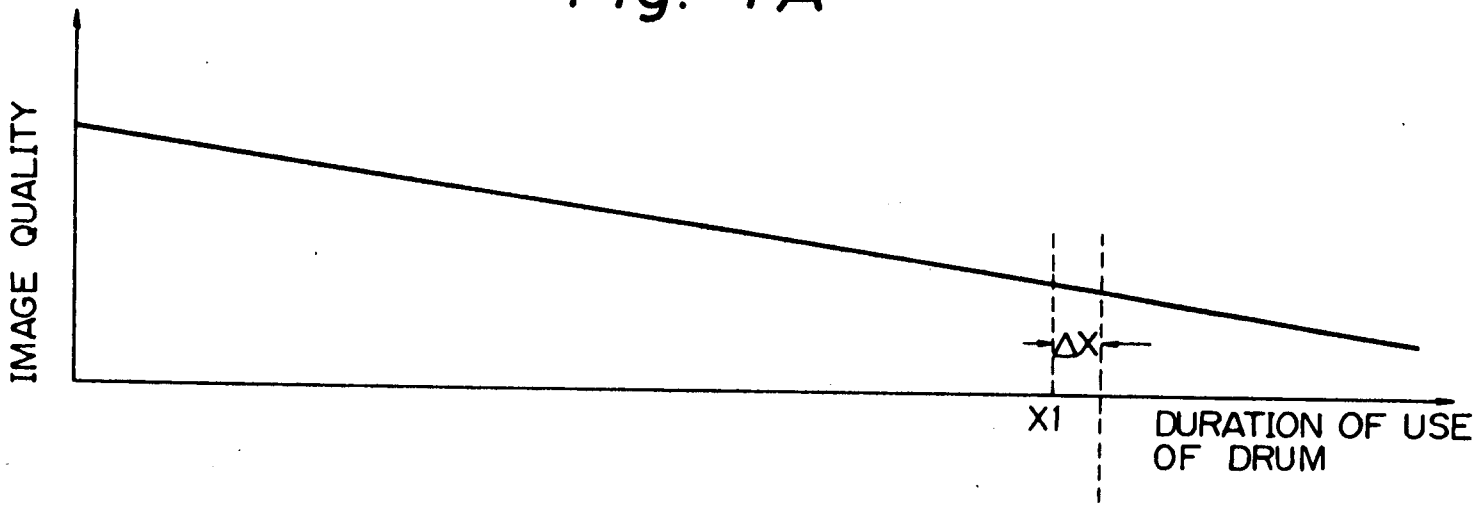
FIGS. 4A and 4B are plots useful for explaining the principle of the first embodiment.
Figure 4B:
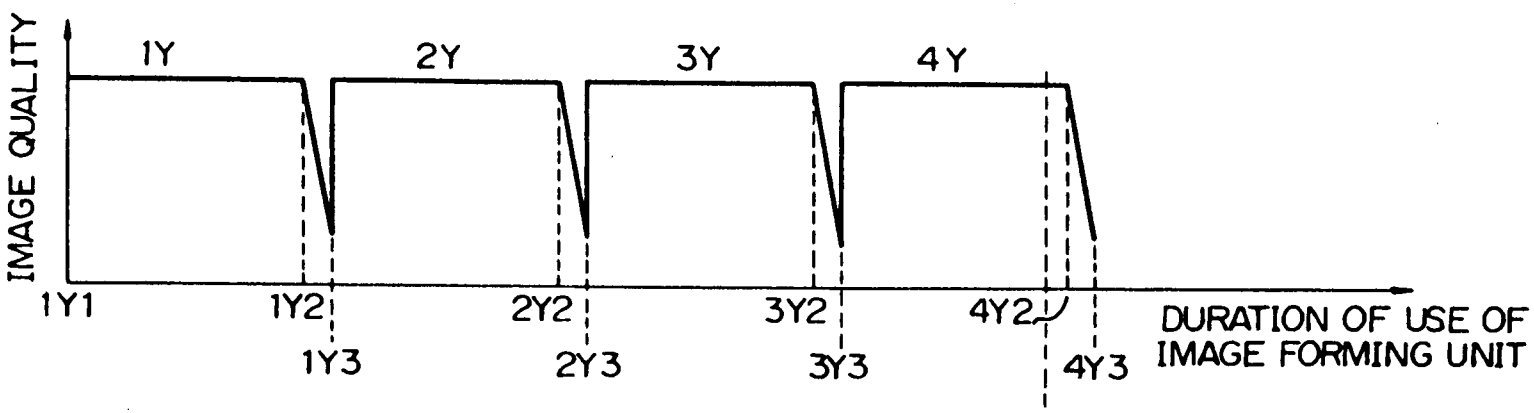

FIG. 4A shows a relationship between the total duration of use of the drum 4 and the quality of toner image which varies due to aging of the drum 4. As shown, the surface of the drum 4 is sequentially deteriorated from the beginning of use to in turn lower the quality of toner image. In this example, it is assumed that the drum life sensor determines at a time X1 that the drum 4 has reached the end of its life. FIG. 4B shows a relationship between the total duration of use of the image forming unit 34 and the quality of toner image which varies as the duration of operation of the unit 34 increases. In FIG. 4B, 1Y is representative of image quality attainable with the first image forming unit, 2Y the image quality attainable with the second image forming unit which is substituted for the first unit, and so on.

As shown in FIG. 4B, after the first unit 34 (1Y) has begun to be used at a time 1Y1, the image quality begins to fall at a time 1Y2 due to, for example, the decrease in the amount of toner stored in the developing device 8. At a time 1Y3, the unit life sensor determines that the life of the unit 34 has expired. Then, a display is turned on to urge a person to replace the first unit 34 with a new unit 34 (2Y). Although the second unit 34 improves the image quality again, the image quality begins to fall at a time 2Y2 and the unit life sensor senses the life of the second unit. Such a process is repeated with the other units 34 (3Y and 4Y) also.

By comparing FIGS. 4A and 4B, it will be seen that the life of the drum, i.e., the interval between the start of use and the time X1 is longer than the interval between the start of use of the individual image forming units and the times 1Y3, 2Y3, 3Y3 and 4Y3 at which the end of their lives is sensed. In the example of FIGS. 4A and 4B, the life of the drum 4 is substantially four times longer than that of a single image forming unit. If the time X1 when the drum 4 reaches the end of its life and the time when an image forming unit reaches the end of its life (e.g. time 4Y3) are coincident, the drum 4 can be replaced simultaneously with the image forming unit to enhance efficient replacing work. In practice, however, the times X1 and 4Y3 are not always coincident and, rather, rarely coincident with each other, as shown in FIGS. 4A and 4B. Specifically, due to the fact that the interval between the start of use of any of those image forming units 34 and the end of its life is greatly dependent upon the conditions in which the copier is used, especially the ratio of an image area to a background area, causing the times X1 and 4Y3 to coincide with each other without fail is impracticable whatever the construction and arrangement of the drum 4 and unit 34 may be. This is why the image forming unit and the drum 34 have heretofore been replaced independently of each other whenever the end of their lives has been sensed, forcing an operator to endure troublesome and frequent manipulation for replacement.

In accordance with the illustrative embodiment, even when the life of the drum 4 expires as sensed by the drum sensor means, the indicator for alerting a person to it is not turned on if the life of the image forming unit in use has not expired and thereby allows the copier to operate continuously. It is not until the image forming units reaches the end of its life that the display is turned on for urging a person to replace both the drum and the image forming unit.

In FIG. 4A, for example, even when the expiration of the life of the drum 4 is sensed at the time X1, the indicator for alerting a person to it is not turned on. Rather, it is at the time 4Y3 at which the life of the image forming unit 4Y expires that the indicator is energized to urge a person to replace not only the unit 4Y but also the drum 4. So long as the timing for replacing the drum 4 is coincident with that for replacing the image forming unit, it is not necessary to replace the drum 4 only and, therefore, efficient operation is promoted.

As shown in FIG. 4A, a time lag ΔX exists between the instant when the end of the life of the drum 4 is sensed and the instant when the drum 4 is actually replaced. The drum 4, therefore, has to be continuously used over the extra duration of ΔX after its life has expired. However, this is acceptable for the following reasons. As shown in FIGS. 4A and 4B, although the image quality sharply falls as the image forming unit approaches the end of its life, it falls very slowly when it comes to the deterioration of the drum 4. That is, the drum 4 is usable over a substantial extra period of time (e.g. ΔX in FIG. 4A) without causing noticeable change in image quality even after the end of its life has sensed. Hence, so long as the total service life of a single image forming unit is relatively short, replacing the drum 4 after using it for a certain extra period of time is permissible in practical use. When the end of the life of the drum 4 and that of the image forming unit are sensed at the same time as may of course occur, the time lag ΔX is zero. To more surely eliminate the above-stated occurrence, the time X1 when the end of the life of the drum 4 is to be sensed may be selected to precede the time when noticeable degradation of image begins due to aging of the drum 4.

The relationship described above with reference to FIGS. 4A and 4B may be tabulated as shown below.

TABLE 1

| DRUM IMAGE FORMING UNIT | END OF LIFE NOT SENSED | END OF LIFE SENSED |
|---|---|---|
| END OF LIFE NOT SENSED | NO DISPLAY | DISPLAY FOR URGING REPLACEMENT OF IMAGE FORMING UNIT ONLY |
| END OF LIFE SENSED | NO DISPLAY (EVEN WHEN END OF DRUM LIFE IS SENSED, DISPLAY IS RESERVED) | DISPLAY FOR URGING REPLACEMENT OF IMAGE FORMING UNIT & DRUM |

A specific example of the above-described construction will be described hereinafter.

Figure 5:
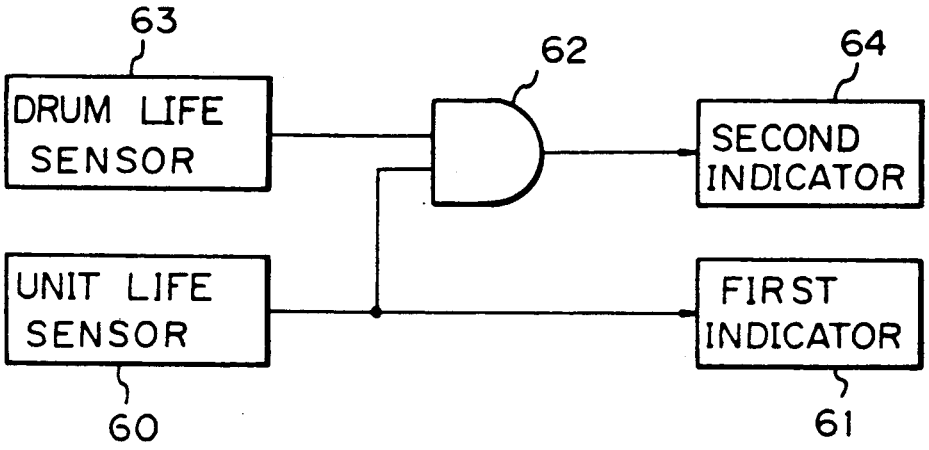
FIGS. 5 and 6 are schematic block diagrams each showing a specific circuit for implementing the principle as shown in FIGS. 4A and 4B.

Referring to FIG. 5, when the life of the image forming unit 34 expires, a unit life sense signal outputted by a unit life sensor 60 is delivered to a first indicator 61 which is mounted on a display panel of the copier body. Consequently, the indicator 61 is turned on to urge a person to replace the image forming unit 34. The output of the unit image sensor 60 is applied to an AND gate 62 as well. When the life of the drum 4 has not expired yet and therefore no drum life sense signal has been applied from a drum life sensor 63 to the AND gate 62, the AND gate 62 does not produce an AND ouput preventing a second indicator 64 associated with the drum 4 from being turned on. That is, only the first indicator 61 is turned on urging a person to replace the image forming unit 34 only. Such a situation corresponds to 1Y3, 2Y3 and 3Y3 shown in FIG. 4B.

Conversely, when the drum life sensor 63 produces a sense signal which is representative of the expiration of the life of the drum 4 while the sense signal from the unit life sensor 60 is absent, the AND gate 62 does not produce an AND output so that the second indicator 64 as well as the first indiator 61 remains turned off. This situation corresponds to the condition which occurs at the time X1 of FIG. 4A, the copying operation being continued without interruption.

Assume that the end of the life of the image forming unit is sensed after the time X1, i.e., while the drum life sensor 63 is producing an output. Then, an AND output of the AND gate 62 and a unit life sense signal from the unit life sensor 60 are delivered to the first indicator 64 and second indicator 61, respectively. Consequently, the indicators 64 and 61 are turned on urging a person to replace both the drum 4 and the image forming unit. This corresponds to the time 4Y3 of FIG. 4B.

In the specific construction shown in FIG. 5, the first indicator 61 serves to urge a person to replace the image forming unit when the end of the life of the unit is sensed. The first indicator 61, second indicator 64 and AND gate 62 constitute a display for urging a person to replace both the image forming unit and the drum 4 when the end of the life of the unit is sensed after that of the drum 4 has been sensed.

Figure 6:
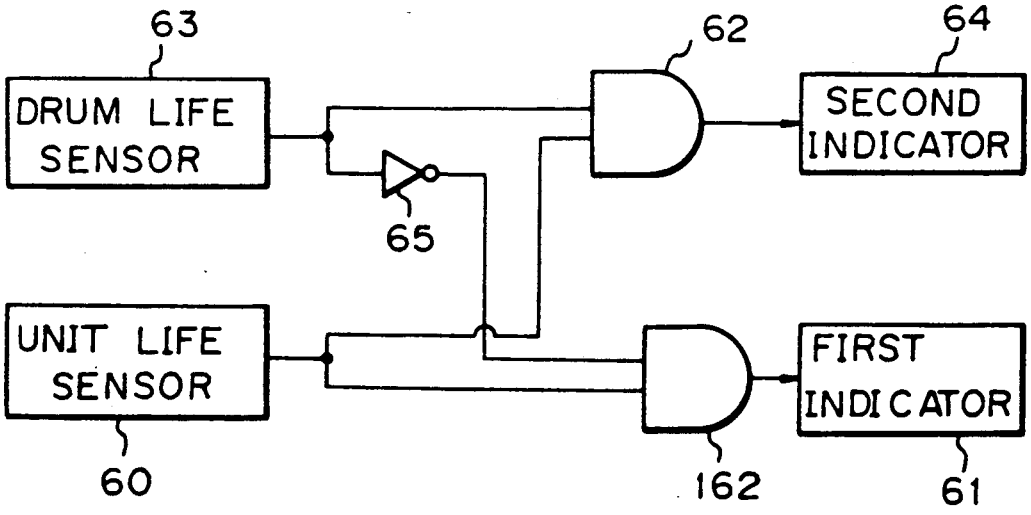

In another specific construction shown in FIG. 6, before any of the sensors 60 and 63 senses that the image forming unit 34 or the drum 4 associated therewith has reached the end of life, the outputs of the sensors 60 and 63 are a (logical) low level each. The output of each of the sensors 60 and 63 has a (logical) high level when the sensor senses the end of the life of the unit 34 or that of the drum 4 associated therewith. Branched into two, the output of the unit life sensor 60 is applied on one hand to a first AND gate 162 and on the other hand to a second AND gate 62. Also branched into two, the output of the drum life sensor 63 is fed on one hand to the second AND gate 62 and on the other hand to the first AND gate 162 via an inverter 65.

When only the life of the image forming unit 34 expires as sensed by the unit life sensor 60 (1Y3, 2Y3 or 3Y3 in FIG. 4B), the output of the sensor 60 becomes a high level and fed to the AND gates 162 and 62. At this instant, the output of the drum life sensor 63 is a low level. Hence, only the output of the first AND gate 162 becomes a high level with the result that the first indicator 61 alone is turned on to urge a person to replace the image forming unit 34 only.

When only the life of the drum 4 expires as sensed by the drum life sensor 63 (X1 in FIG. 4A), the output of the sensor 63 has a high level. Since the output of the unit life sensor 60 is a low level, none of the AND gates 62 and 62 produces a high level output maintaining both of the indicators 61 and 64 turned off.

As the end of the life of the image forming unit 34 is sensed after the time X1, i.e., after the end of the life of the drum 4 has been sensed to make the output of the sensor 63 a high level (4Y3 in FIG. 4B), both the sensor 60 and the sensor 63 produce high level outputs. As a result, the high level output and low level output of the sensors are fed to the first AND gate 162 so that the first indicator 61 is kept deactivated. On the other hand, the high level outputs of the sensors 60 and 63 are applied to the second AND gate to turn on the second indicator 64, urging a person to replace both the drum 4 and the image forming unit 34.

In the arrangement shown in FIG. 6, when both the drum 4 and the image forming unit 34 need replacement, only the second indicator 64 responsive to such an occurrence is turned on while the first indicator 61 remains turned off. This allows a person to see what the displays 61 and 62 mean at a glance. The first indicator 51 and first AND gate 162 constitute a major part of means for showing that the image forming unit 34 has to be replaced. Likewise, the second indicator 64 and first and second AND gates 162 and 62 constitute a major part of means for showing that both the image forming unit 34 and the drum 4 have to be replaced.

In the examples shown in FIGS. 4A, 4B, 5 and 6, although a time lag ΔX exists between the time when the end of the life of the drum 4 is sensed and the time when the drum 4 is actually replaced, it is acceptable, as previously stated. However, the time lag ΔX may be as long as the total life of a single image forming unit at maximum. In such a condition, it may occur that the drum 4 becomes deteriorated to a significant extent before the actual timing for replacement is reached, critically lowering the image quality.

Figure 7A:
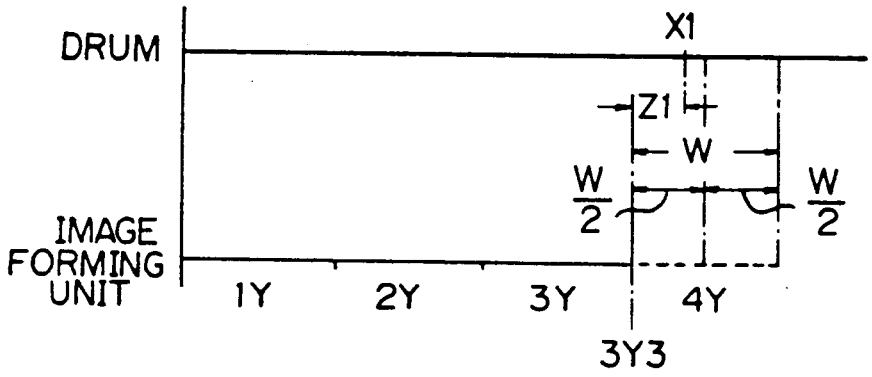
FIGS. 7A and 7B and 8A and 8B are views similar to FIGS. 4A and 4B, each showing the principle of a modification to the principle of FIGS. 4A and 4B.
Figure 7B:
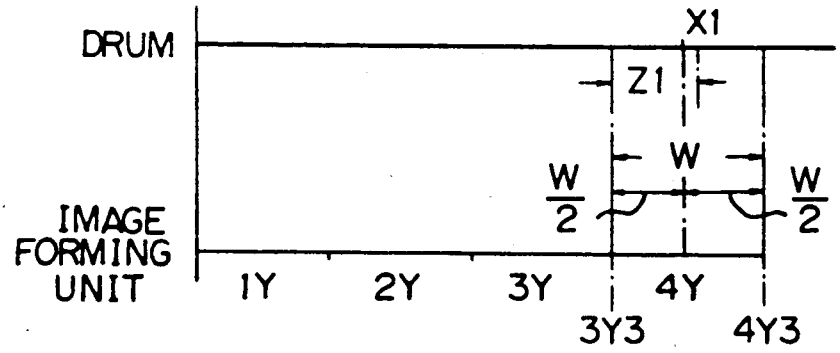

To reduce the time lag ΔX mentioned above, a method shown in FIGS. 7A and 7B may advantageously be adopted. In FIGS. 7A and 7B, assume that the life of the drum 4 expires at a time X1 while image forming units are sequentially replaced as represented by 1Y, 2Y, 3Y and so on. When any of the image forming units reaches the end of its life, a period of time which is available before the expiration of the life of the drum 4 (i.e. before the time X1 is reached) is determined. If it is decided that the time X1 will be reached while the next image forming unit is in use, whether to replace the drum 4 before the next image forming unit is used or to replace it after the next image forming unit has been used is determined depending upon how long the drum 4 is usable. For example, when the end of the life of the image forming unit 34 as represented by 3Y in FIG. 7A is sensed at a time 3Y3 and if the period of time Z1 between the time 3Y3 and the time time when the life of the drum 4 expires is, for example, shorter than one half of the total service life W of a single image forming unit, not only the image forming unit but also the drum 4 are replaced at the time 3Y3. Conversely, as shown in FIG. 7B, if the above-mentioned period of time Z1 is, for example, longer than W/2, only the image forming unit is replaced at the time 3Y3 and, then, both the subsequent unit 4Y and the drum 4 are replaced at a time 4Y3 at which the life of the unit 4Y expires.

With the above principle, it is possible to reduce the time lag ΔX shown in FIGS. 4A and 4B to one half of the total service life of a single image forming unit at maximum.

Figure 8A:
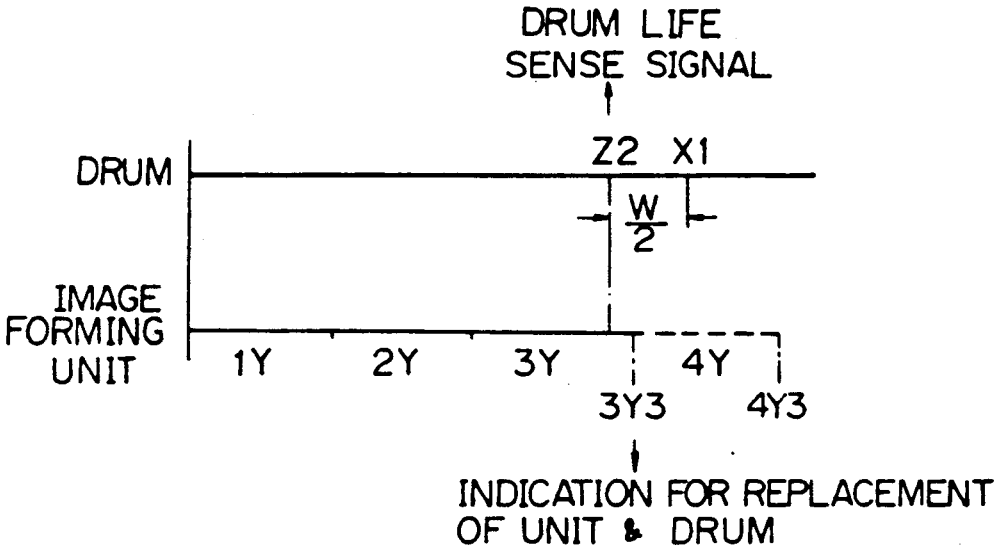
Figure 8B:
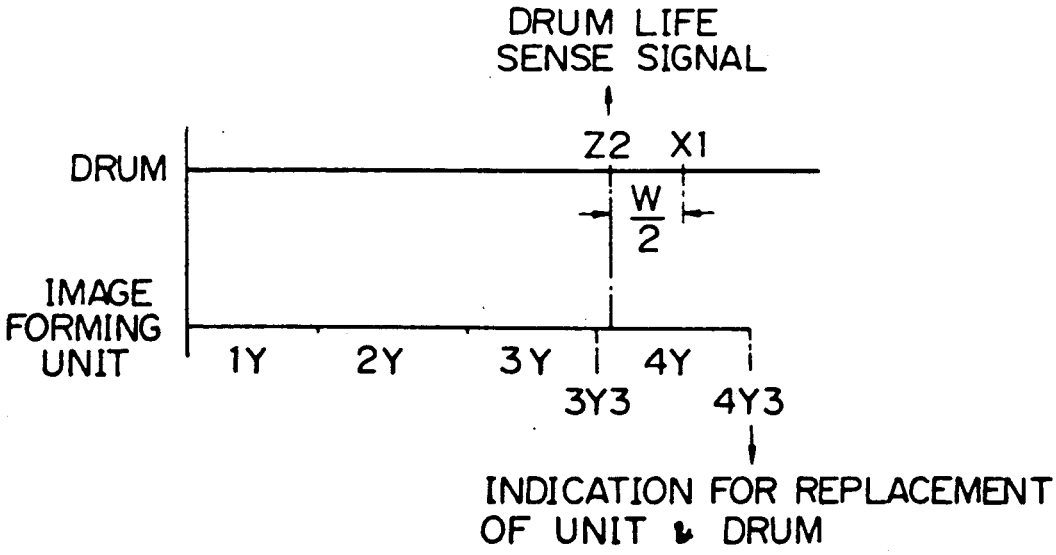

FIGS. 8A and 8B are diagrams showing a practical method of implementing the principle described above. In these figures, X1 is representative of the time when the life of the drum 4 expires, as in FIGS. 7A and 7B. In this example, the drum life sensor 63 shown in FIG. 5 or 6 does not produce a sense signal at the time X1. Instead, it produces a sense signal at a time Z2 which is earlier than the time Z1 by one half of the average service life W of a single image forming unit, as shown in FIGS. 8A and 8B. The rest of the construction is just as described in relation to the previous example. Specifically, as shown in FIG. 8A, when the drum life sensor 63 produces a sense signal, the indicator for urging a person to replace both the drum 4 and the image forming unit 3Y is not turned on, or reserved, if the end of the life of the unit 3Y is not sensed. It is only when the end of the life of the unit 3Y is sensed at the time 3Y3 that the above-mentioned indication is provided. In the case of FIG. 8B, when the drum life sensor 63 produces a sense signal, the next image forming unit represented by 4Y has already been used; the indication for urging a person to replace both the drum 4 and the unit 4Y is produced at a time 4Y3 at which the end of the life of the unit 4Y is sensed.

Summarizing the above procedure, the time at which the drum life sensor 63 is to produce a sense signal occurs earlier by W/2 than the time X1 at which the life of the drum 4 is to expire, and the indication for causing both the drum 4 and the image forming unit 34 to be replaced is produced when the end of the life of the unit 34 is sensed after that of the drum 4 has been sensed.

A specific method of defining the time Z2 is as follows. Assume that the drum life sensor 63 is constructed to sense the end of the life of the drum 4 by counting the number of copies produced as described later, that the number m of copies produced up to the time X1 is 10,000, and that the average life W of a single image forming unit is 3,000 in terms of the number of copies produced. Then, since W/2 is 1,500, the time Z2 is reached when the drum life sensor counts the 8,500th copy and produces an output.

The principle discussed with reference to FIGS. 8A and 8B may also be implemented by using the construction of FIG. 5 or that of FIG. 6.

The example shown in FIGS. 8A and 8B implements the construction of FIGS. 7A and 7B by advancing the time at which the drum life sensor 63 produces a sense signal by one half of the average life W of the image forming unit relative to that of FIGS. 4A and 4B, as stated earlier. Such a construction is successful in reducing the time lag ΔX as shown in FIGS. 4A and 4B. What is common to the two examples is that the indication for causing both the drum 4 and the image forming unit to be replaced is produced when the end of the life of the image forming unit is sensed after the life of the drum 4 has expired (after the time X1 or Z2). In any of the two examples, the time when the drum life sensor 63 produces a sense signal (X1, Z2) and the time when the unit life sensor 60 produces a sense signal may of course be coincident with each other.

With the examples shown in FIGS. 7A and 7B and FIGS. 8A and 8B, it is possible to reduce the time lag ΔX of FIGS. 4A and 4B so that the drum 4 the life of which has expired is prevented from being continuously used over a long period of time. However, in the case that the image forming unit is so constructed as to achieve an extended service life, W/2 shown in FIGS. 7A and 7B and FIGS. 8A and 8A is increased. Hence, even with any of the two examples the drum 4 it may occur that the drum 4 whose life has expired has to serve over a long period of time. The illustrative embodiment further includes an implementation for eliminating such an occurrence, as described hereunder.

Figure 9A:
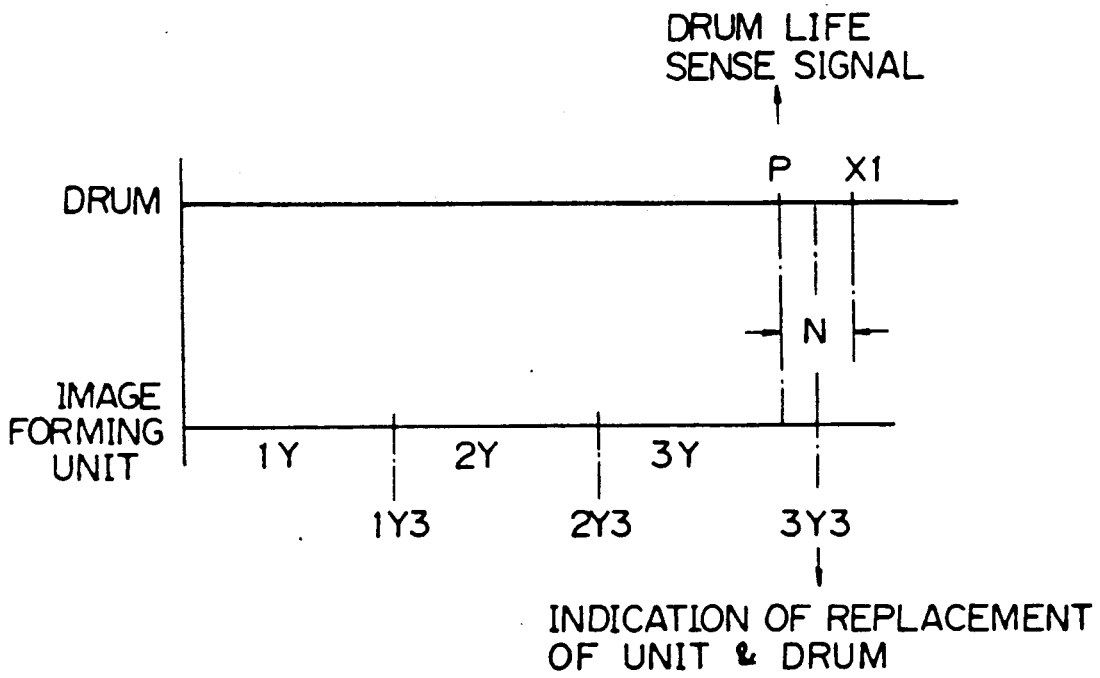
FIGS. 9A and 9B are plots showing another modification.
Figure 9B:
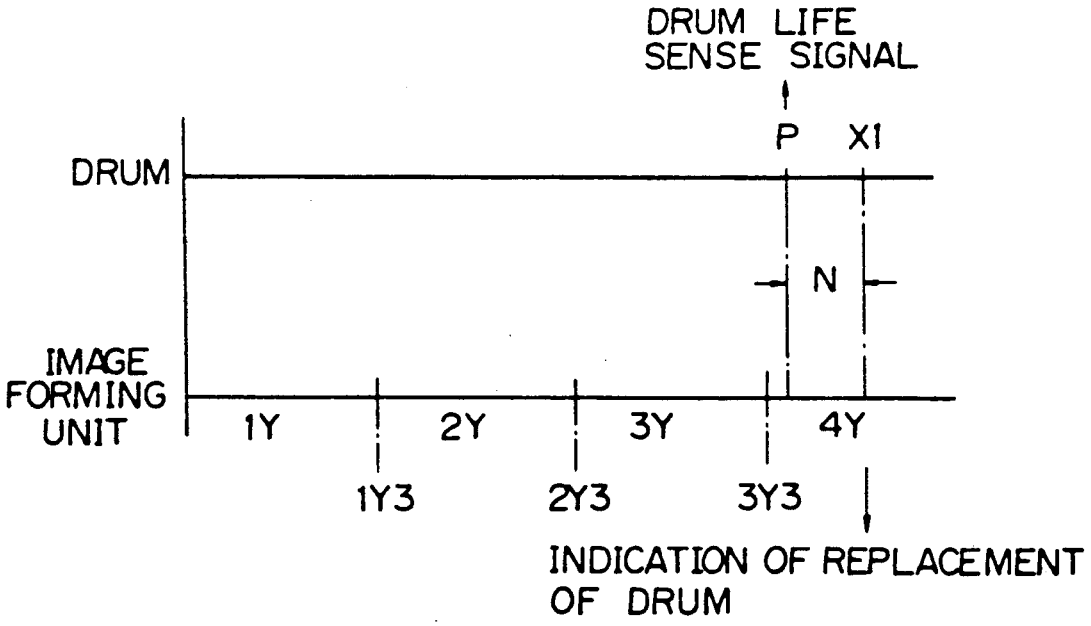

FIGS. 9A and 9B are diagrams demonstrating the principle of the above-mentioned implemantation. In the figures, X1 is representative of the time when the life of the drum 4 expires as in the example of FIGS. 8A and 8B. Again, the end of the life of the drum 4 is sensed not at the time X1 but at a time P which is somewhat earlier than the time X1. Assume that a toner image is formed predetermined N times on the drum 4 (meaning that the copying cycle is repeated N times in this example) during the interval between the time P and the time X1. In FIGS. 9A and 9B, 1Y, 2Y and so on show that image forming units 34 are used one after another. As shown, the total service life of a single image forming unit is shorter than that of the drum 4.

Assume that the end of the life of the image forming unit 34 (3Y) being used is sensed at a time 3Y3 which follows the time P and precedes the time at which predetermined N copies are produced. Then, the indication for urging a person to replace both the unit 34 (3Y) and the drum 4 is produced at the time 3Y3. This kind of condition will hereinafter be referred to as a first mode.

Next, as shown in FIG. 9B, assume that the end of the life of the image forming unit 34 (3Y) being used is not sensed after the time P and until the N times of copying cycle has been completed. Then, the indication for urging a person to replace the drum 4 only is produced after the copying cycle has been repeated N times, i.e. at the time X1. This particular condition will hereinafter be referred to as a second mode.

When the end of the life of the image forming unit 34 is sensed at a certain time outside of the range in which the copying cycle is executed N times after the time P, i.e., the time 1Y3 or 2Y3 shown in FIG. 9A or the time 1Y3, 2Y3 or 3Y3 shown in FIG. 9B, the indication commanding the replacement of only the unit 34 being used is produced. This will hereinafter be referred to as a third mode.

The third mode, like any of the previously described examples, causes only the image forming unit 34 to be replaced when its life expires. The first mode is adapted to urge a person to replace the drum 4 and the image forming unit 34 at the same time when the life of the drum 4 expires or substantially expires and that of the unit 34 expires. Further, the second mode is adapted to replace only the drum 4 when the life thereof expires alone. By the addition of such a second mode, the drum 4 the life of which has expired is prevented from being used over a long time even when the total service life of a single image forming unit 34 is long. This is because when the drum 4 is used until the time X1 is reached, it is replaced even if the image forming unit 34 is still usable. Further, the first mode allows the timing for replacing the drum 4 and that for replacing the unit 34 to become coincident with each other to cause the drum 4 and the unit 34 to be replaced at the same time, reducing the frequency of replacement of the drum 4 or that of the unit 34 compared to the prior art.

For example, assume that a toner image is produced (a copying cycle is repeated in this example) 100,000 consecutive times during the interval between the start of use of a new drum 4 and the end of its life which is sensed at the time X1 of FIGS. 9A and 9B, and that the average total service life of a single unit 34 is 30,000 in terms of the frequency of copying cycle repeated (in practice the frequency of copying cycle is not constant and depends upon the conditions of use of a copier). Then, N is selected to be 5,000 by way of example. In this condition, even if the life of each image forming unit 34 is as long as 30,000 in terms of the frequency of copying cycle executed, the drum 4 is necessarily replaced while the number of copying cycles repeated increases from 100,000−5,000=95,000 to 100,000. This prevents the drum 4 from being continuously used even after it has been deteriorated.

It is to be noted that the time X1 does not always have to be coincident with the frequency of use (number of copying cycles) at which a noticeable fall of image quality begins, i.e., the former may be somewhat greater or smaller than the latter. This is because the deterioration of the drum 4 does not abruptly occur and, therefore, some deviation of the time X1 has no critical influence on the actual use of the copier, as discussed earlier with reference to FIGS. 4A and 4B. The gist is that a certain number of copying cycles should be selected to define the end of life X1 on the basis of the frequency of use of the drum 4 which occurs before noticeable degradation of image quality begins. This is also true with the examples of FIGS. 7A and 7B and FIGS. 8A and 8B. The predetermined frequency N, too, need only be selected on the basis of X1 by taking account of economical use of the drum 4 as well as the frequency of replacement. Specifically, when N is relatively large, the probability that the drum 4 and the unit 34 can be replaced at the same time is increased to reduce the overall frequency of replacement although the drum 4 may sometimes have to be replaced before its life expires. When N is relatively small, the situation is the opposite.

Figure 10:
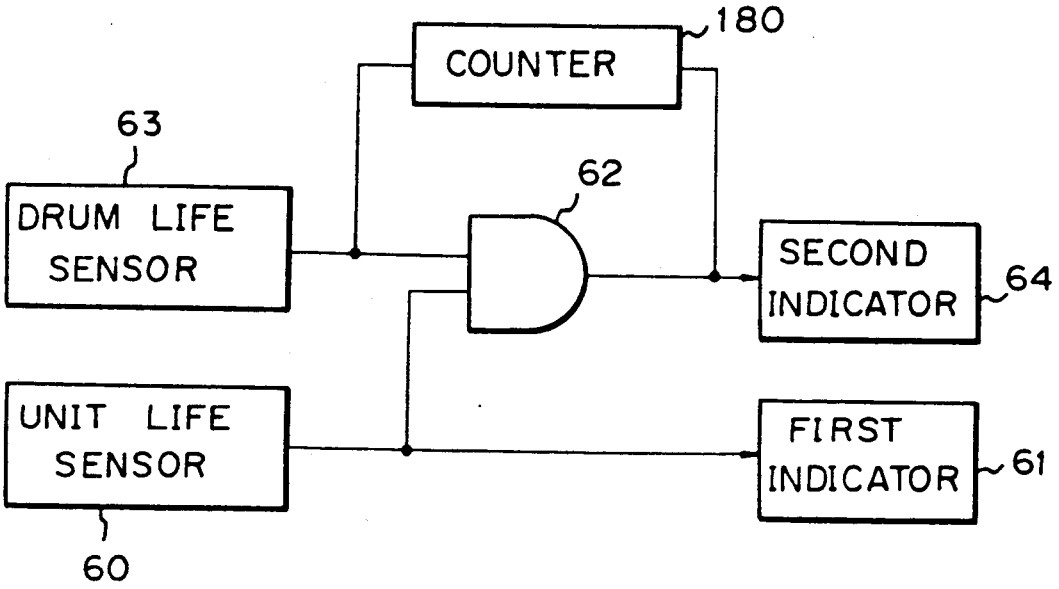
FIGS. 10 and 11 are schematic block diagrams each showing a specific circuit for implementing the principle as shown in FIGS. 9A and 9B.

Referring to FIG. 10, a specific construction for practicing the method of FIGS. 9A and 9B is shown. The circuitry of FIG. 10 is the same as the circuitry of FIG. 5 except that a counter 180 is connected in parallel with the AND gate 52, that the output of the drum life sensor 63 is applied to the counter 180 as well, and that the output of the counter 180 is connected to the second display 64. In operation, when the unit life sensor 60 senses the end of the life of the image forming unit 34 (1Y, 2Y, . . . ), its output is fed to the first indicator 61 which is then turned on to urge a person to replace the unit 34. Although this output of the unit life sensor 60 is applied to the AND gate 62 as well, the total duration of use of the drum 4 (total number of copying cycles) is short of P. Hence, so long as the output of the drum life sensor 63 is not applied to the AND gate 62, the AND gate 62 produces no AND output maintaining the second indicator 64 turned off. As a result, only the first indicator 61 is turned on to inform a person of the fact that the time for replacing the image forming unit 38 only is reached. This situation corresponds to 1Y3 and 2Y3 of FIG. 9A and 1Y3, 2Y3 and 3Y3 of FIG. 9B, i.e. third mode.

The first mode is as follows. When the total duration of use of the drum 4 reaches P as shown in FIG. 9A, the drum life sensor 63 delivers a sense signal to the AND gate 62 as well as to the counter 180. Then, the counter 180 begins to count up the copying cycles which are sequentially performed by the copier. When the counter 180 reaches the predetermined count N, the duration of use of the drum 4 reaches X1. When the end of the life of the image forming unit 34 being used is sensed (time 3Y3 of FIG. 9A) within the range of the predetermined number of copying cycles N after the time P, i.e., when the drum life sensor 63 is producing a sense signal, the unit life sensor 60 produces a sense output and delivers it to the AND gate 62 and the first display 61. This turns on the first indicator 61. Simultaneously, the AND gate 62 produces an AND output in response to the sense signals from the sensors 60 and 63. The AND output is fed to the second indicator 64 to turn it on. Observing the two indicators 61 and 64 which are turned on, a person sees that both the drum 4 and the unit 34 have to be replaced. This is the first mode. It is to be noted that even when the drum life sense signal appears after the time P, the AND gate 62 does not produce an AND output until the unit life sense signal appears and therefore maintains the indicators 61 and 64 turned off.

When the end of the life of the image forming unit 34 is not sensed within the range of N copying cycles, which is counted by the counter 180, when the drum life sensor is being produced after the time P, an output of the counter 180 is applied to the second indicator 64 when the counter 180 has counted N. Consequently, only the second indicator 64 is turned on urging a person to replace the drum 4 only. This is the second mode.

Figure 11:
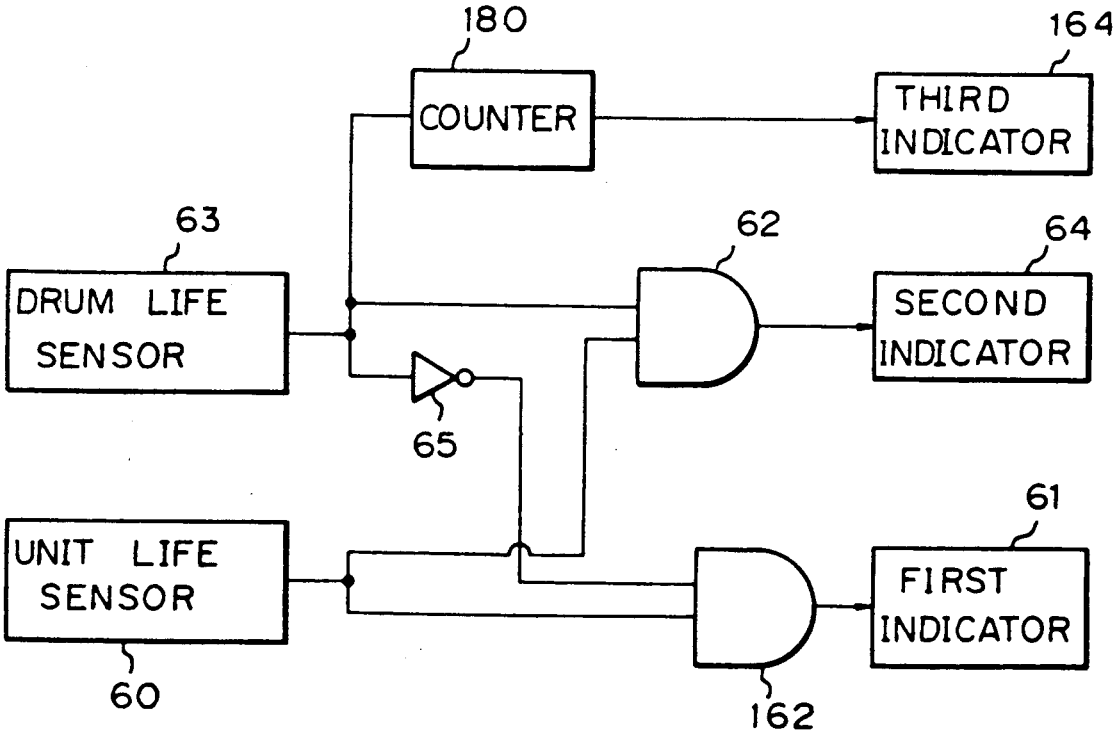
Figure 12:
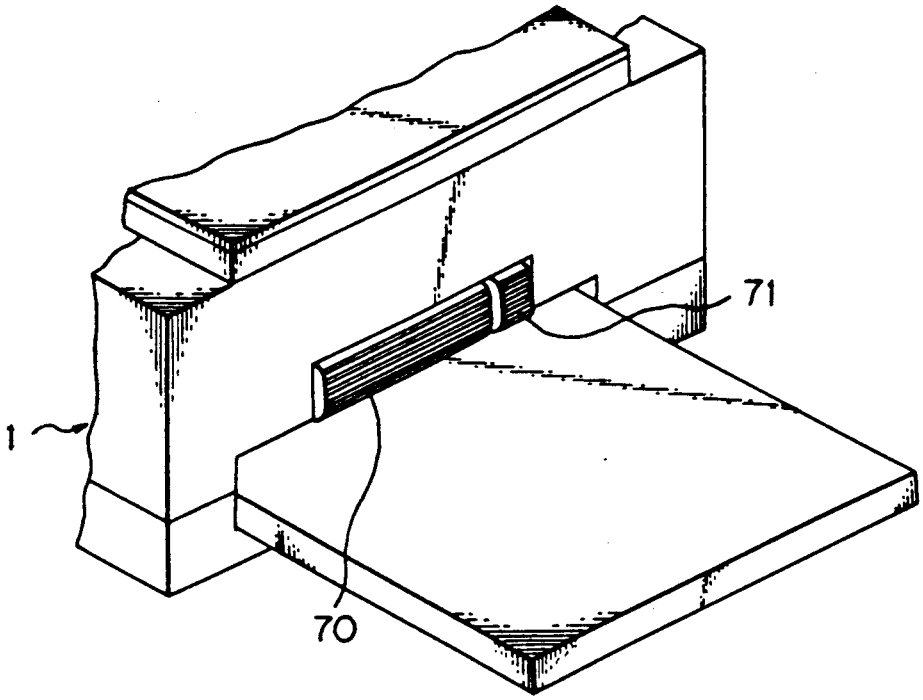
FIG. 12 is a perspective view of a copier which includes levers for manipulation.

FIG. 11 shows another specific construction for practicing the method of FIGS. 9A and 9B. The construction shown in FIG. 11 is similar to that of FIG. 6 except that the output of the drum life sensor 63 is connected to the counter 180 as well, and that the output of the counter 180 is connected to a third indicator which is also provided on the display panel of the copier. In the third mode which occurs when only the end of the life of the image forming unit 34 is sensed (1Y3 and 2Y3 of FIG. 9A and 1Y3, 2Y3 and 3Y3 of FIG. 9B), the output of the unit life sensor 60 becomes a high level and fed to the AND gates 162 and 62. The output of the drum life sensor 63 which is a low level is fed to the counter 180, to the second AND gate 62, and to the first AND gate 162 via the inverter 56. Consequently, the input to the counter 180 is a low level and therefore fails to start the counter 180. In this condition, only the output of the first AND gate 162 becomes a high level to turn on the first indicator 61 only, urging a person to replace the image forming unit 34 only.

In the first mode, when the drum life sensor 63 senses the end of the life of the drum 4 at the time P of FIG. 9A, its output has a high level and is fed to the counter 180 and the second AND gate 62. At the same time, this counter output is applied to the first AND gate 162 via the inverter 65. As a result, the counter 180 is incremented every time the copying cycle is performed. When the end of the life of the image forming unit 34 is sensed before the counter 180 counts N, the output of the unit life sensor 60 becomes a high level. In response to the high level outputs of the two sensors 63 and 64, the second AND gate 62 turns on the second indicator 64. On the other hand, the high and low level outputs of the sensors 63 and 60 are fed to the first AND gate 162 so that the first indicator 61 is held turned off. Since the counter 180 has not counted N yet, no signal is fed from the counter 180 to the third indicator 164 resulting in the display 164 being maintained turned off. In this manner, only the second indicator 64 is turned on informing a person of the fact that both the drum 4 and the unit 34 should be replaced.

Assume that the end of the life of the iamge forming unit 34 is not sensed until the counter 180 counts N after the time P, an output of the counter 180 is fed to the third indicator 164. At this instant, since the outputs of the AND gates 62 and 162 each has a low level, only the third indicator 164 is turned on urging a person to replace the drum 4 only. This is the second mode.

As described above, each of the specific constructions shown in FIGS. 10 and 11 causes particular indicators to turn on depending upon the mode. This eliminates the fear that a person erroneously recognizes what is meant by the indicators.

A person replaces any of the structural elements as guided by the indicators 61, 64 and 164. When only the image forming unit 34 should be replaced, the replacement will be facilitated if only the unit 34 is raised with the drum 4 left in the lower assembly 52, as shown in FIG. 2. When both the drum 4 and the unit 34 should be replaced, they will advantageously be removed together from the upper assembly 51 if the drum 4 can be raised together with the unit 34. Further, when a paper transport path defined below the drum 4 in the condition shown in FIG. 1 is jammed by a paper, the paper can readily be removed if the drum 4 is movable upward integrally with the unit 34. An arrangement which implements such capabilities will be described hereinafter.

Referring to FIGS. 1 to 3, 12 and 13, the copier body 1 is provided with a first lever 70 and a second lever 71 which are individually accessible from the outside of the copier body 1. As clearly shown in FIG. 13, a lever hook 74 is connected to the first lever 70 by a connecting member 73. The lever hook 74 is rotatably supported by a pivot pin 75 which is fixed to a side frame, not shown, of the upper assembly 51. When the upper assembly 51 is held in a closed position as shown in FIG. 1, the lever hook 74 is engaged with a lock pin 76 which is rigid on a post 100 of the lower assembly 52. This locks the upper assembly 51 to the lower assembly 52. On the other hand, a rotary member 78 is fixed to the second lever 71 by a connecting member 77 and is rotatably supported by a pin 75. Rotatably connected to a lower portion of the member 78 is one end of a link 79 the other end of which is rotatably connected to a drum shaft hook 80. The drum shaft hook 80 is rotatably supported by a pin 81 which is studded on a side frame of the upper structure 51 which is located at the rear of the drum 4. When the upper assembly is closed as shown in FIG. 1, the drum shaft hook 80 remains in engagement with the drum shaft 54.

Figure 13:
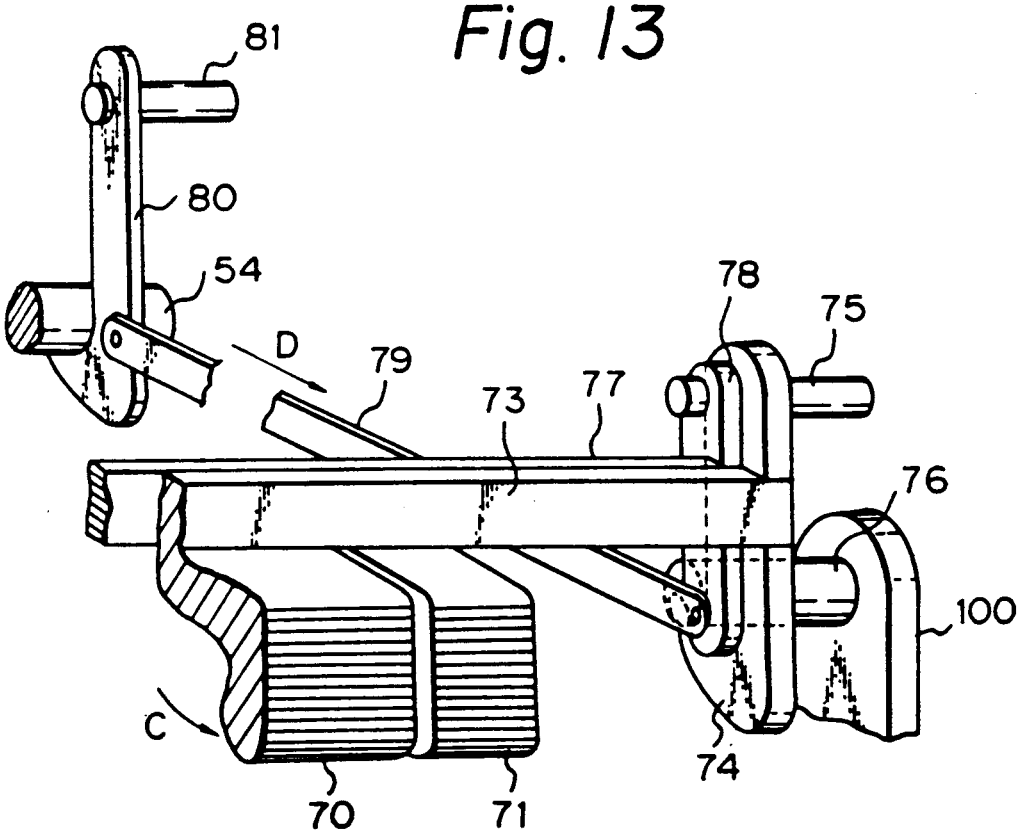
FIG. 13 is a perspective view showing the levers of FIG. 12 together with various elements associated therewith.

While FIG. 13 shows various elements which are associated with the levers 70 and 71 and located at the rear of the drum 4, it will be apparent that similar elements which are designated by like reference numerals are located at the front of the drum 4. Such drum shaft hooks 80 are individually engaged with the drum shafts 54 of the drum 4. A side frame 101 of the upper assembly 51 which supports the front drum shaft hook 80 is partly shown in FIG. 2.

When the life of the image forming unit 34 expires as previously stated, the second lever 71 is manually pulled in a direction indicated by an arrow C, FIGS. 1 and 13. This causes the member 78 to rotate in the direction C so that the link 79 is pulled to the right as viewed in FIG. 1 (arrow D). Consequently, the drum hook 80 is released from the drum shaft 54 (see FIG. 2). In this instance, the connecting member 77 associated with the second lever 71 is positioned more inwardly than the connecting member 73 associated with the first lever 70 and, in addition, the members 77 and 73 are abutted against or located close each other. Hence, when the second lever 71 is pulled in the direction C, the connecting member 73 is entrained in the same direction causing the lever hook 74 to rotate in the direction C away from the lock pin 76. Then, as the upper assembly 51 is rotated in the direction A with the second lever 71 gripped by hand, the drum 4 is left on the support member 55 and only the image forming unit 34 is raised together with the upper assembly 51, as shown in FIG. 2. This allows a person to readily remove the image forming unit 34 only for replacement as guided by the indicators.

When both the image forming unit 34 and the drum 4 should be replaced or when the papaer transport path is jammed by a paper, the first lever 70 is rotated in the direction C until the lever hook 74 is released from the lock pin 76. In this instance, since the connecting member 73 associated with the first lever 70 is located outwardly (at the right as viewed in FIGS. 2 and 3) of the connecting member 77 which is associated with the second lever 71, the lever 70 being rotated does not effect the connecting member 77. Hence, the drum shaft hook 80 remains in engagement with the drum shaft 54.

When the upper assembly 51 raised with the first lever 71 gripped by hand, it entrains the drum 4 as well as the image forming unit 34 as shown in FIG. 3 because the hook 80 is engaged with the drum shaft 54. Hence, a person can replace the unit 34 and drum 4 with ease or can readily remove a jamming sheet from the paper transport path which is uncovered.

Figure 14:
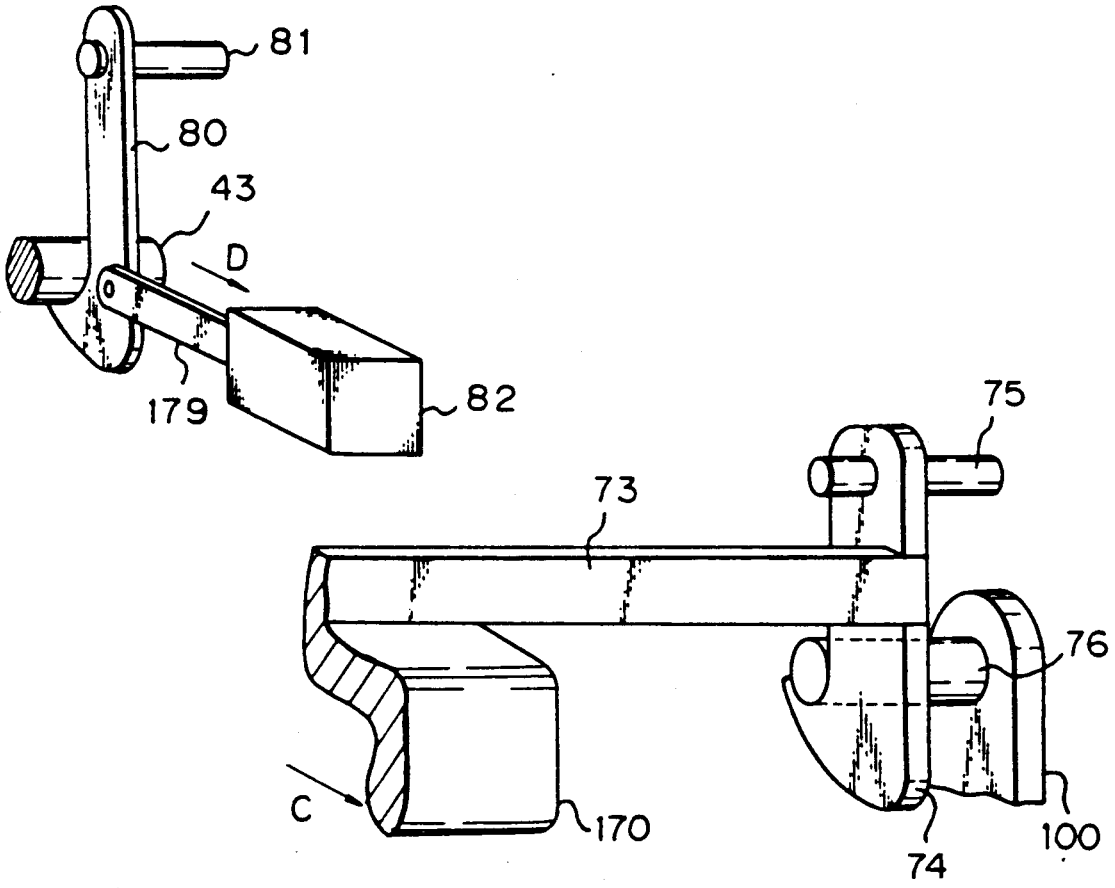
FIG. 14 is a view similar to FIG. 13, showing a modification to the consruction of FIG. 13.

In a modification shown in FIG. 14, only a lever 170 which corresponds to the first lever 70 of FIG. 13 is provided, i.e., the second lever 71 is omitted. A plunger of a solenoid 82 is connected to the connecting link 179.

When only the image forming unit 34 should be replaced, the solenoid 82 is energized by a sensor output to pull the connecting link 179 in the direction D until the drum shaft hook 80 becomes clear of the drum shaft 43. In this condition, as the lever 170 is manually pulled in the direction C, the lever hook 74 is released from the lock pin 76. When the upper assembly 51 is raised with the lever 170 gripped by hand, only the unit 34 is raised with the drum 4 left in the lower assembly 5, as shown in FIG. 2. Then, the unit 34 can be replaced with ease. When both the unit 34 and the drum 4 should be replaced or when a jam signal is produced, the solenoid 82 is not energized and therefore the hook 80 remains in engagement with the drum shaft 43. In this condition, as the lever 170 is pulled in the direction C to raise the upper assembly 51, the drum 4 is raised along with the upper assembly 51, as shown in FIG. 3. This facilitates the replacement of the unit 34 and drum 4 or the removal of a jamming sheet.

An advantage attainable with the modification of FIG. 14 is that, whatever the kind of work may be, all that is required is manipulating the same lever 170. The result is the elimination of erroneous operations.

Specific constructions of the drum life sensor and unit life sensor will be described.

The drum life sensor may be implemented by means which counts copies which are sequentially produced and produces a drum life sense signal when a predetermined number of copies are produced. For details of such means, a reference may be made to Japanese Laid-Open Patent Publication (Kokai) No. 52-46838. Alternatively, the drum life sensor may be constructed to produce a drum life sense signal when the drum 4 is rotated a predetermined number of times. Further, paying attention to the fact that the surface potential of the drum 4 varies with the deterioration of the photoconductive layer of the drum 4, the drum life signal may be produced by measuring the surface potential after exposure or after discharge and comparing the surface potential measured with a reference potential to thereby sense the deterioration of the drum 4.

Figure 15:
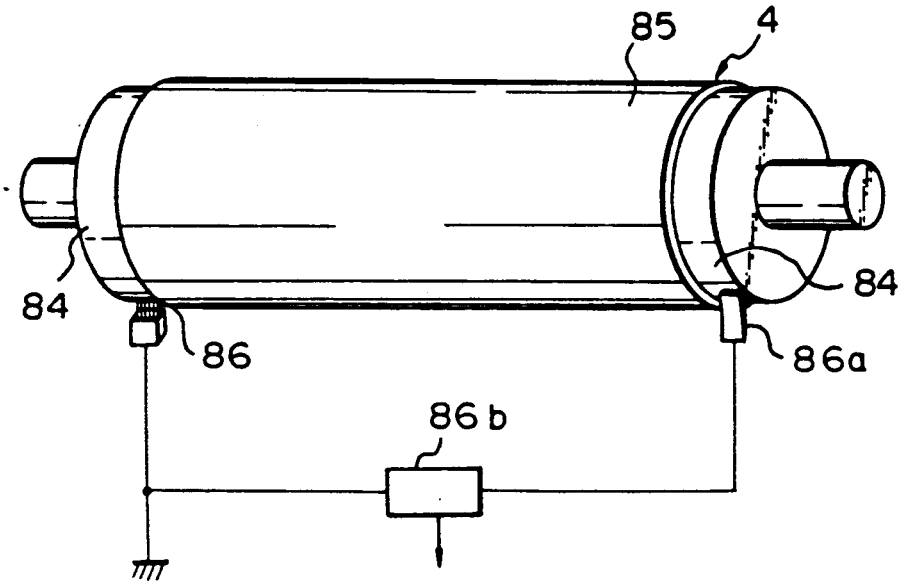
FIG. 15 is a perspective view showing a specific construction of a drum life sensor.
Figure 16:
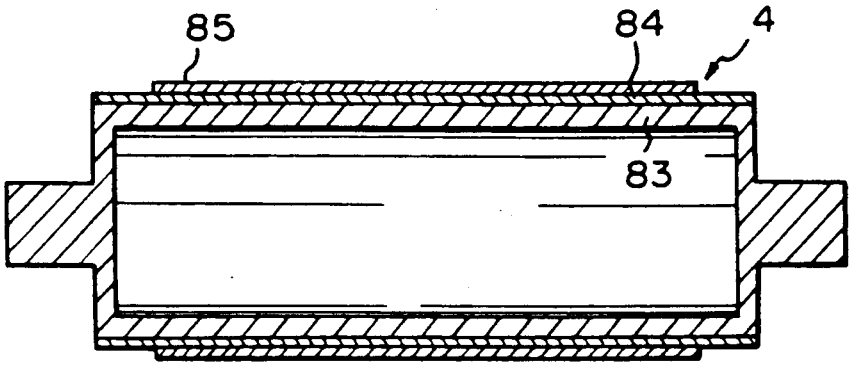
FIG. 16 is a vertical section of a photoconductive element which is shown in FIG. 15.

FIGS. 15 and 16 show a specific example of the drum life sensor. As shown, the drum 4 includes a support member 83 which is made of an insulating material, a conductive layer 85 deposited on the outer periphery of the support member 83, and a photoconductive layer 85 coated on the conducive layer 84. A ground brush 86 and a conductive contact member **86*a* are individually abutted against those opposite parts of the conductive layer 84 which are exposed to the outside. A sensing circuit 86*b* which is similar to an ordinary snap or disconnection sensing circuit is connected to the ground brush 86 and contact member 86*a*. While the drum 4 is fresh, the ground brush 86 and contact member 86*a* are electrically connected to each other via the conductive layer 84. While the drum 4 is repeatedly used, the conductive layer 84 held in contact with the contact member 86*a* wears to effect the conduction between the ground brush 86 and the contact member 86*a*. Upon sensing this occurrence, the sensing circuit 86*b*** produces a drum life sense signal.

A specific construction of the unit life sensor associated with the image forming unit 34 will be described. As shown in FIG. 1, a sensing plate 87 is rotatably supported within the casing 10 of the developing device 8 as shown in FIG. 1. The sensing plate 87 lies on the toner 9 which is stored in the casing 10. In an initial condition wherein the amount of toner 9 is sufficient, the sensing plate 87 remains in a substantially horizontal position as represented by a solid line in FIG. 1. As the toner 9 is sequentially consumed, the sensing plate 87 is angularly moved clockwise as viewed in FIG. 1 and finally inclined as indicated by a phantom line in the same figure. A lug 88 extending from the sensing plate 87 is moved together with the plate 87. A microswitch, an optical sensor or like sensing device senses the movement of the lug 87 to determine that the remaining amount of toner 9 is reduced beyond a predetermined amount. Alternatively, an agitator for agitating the toner 9 may be disposed in the casing 10 in order to sense a decrease in the amount of toner beyond the predetermined amount in terms of fluctuation of the torque of the agitator, although not shown in FIG. 1. Specifically, the torque of the agitator is great when the amount of toner 9 in the casing 10 is great, but it decreases with the decrease in the amount of toner 9; a unit life sense signal is produced when a decrease in the amount of toner 9 to below a predetermined amount is sensed.

Another possible implementation for sensing the life of the image forming unit 38 is sensing the amount of toner which is collected in the cleaning casing 20. For example, the copier shown in FIG. 1 includes a roller 89 for forcing toner which is collected from the drum 4 into the toner containing section **20*a* of the casing 20. The amount of toner collected may be sensed in terms of fluctuation of the torque of the roller 89. Alternatively, a rotatable blade, not shown, may be positioned in the toner containing section 20*a* so that the life of the cleaning device may be decided in terms of variation in the torque of the blade, i.e., a life sense signal is produced when the sequentially increasing torque reaches a predetermined value. Further, as shown in FIG. 1, a rubber member 90 may be so positioned as to cover an opening which is formed through the top wall of the casing 20. In this case, the rubber member 90 is forced upward by the toner which is sequentially fed into the toner containing section 20*a*. When a lug 90*a* extending from the rubber member 90** is sensed by a microswich or an optical sensor, not shown, the latter produces a sense signal.

The above-described sensors may individually be associated with the developing device 8 and the cleaning device 18 to serve as unit life sensors, so that a sense signal outputted by any one of the sensors may be representative of the end of the life of the image forming unit 38. However, only one of those sensors may of course be used.

Figure 17:
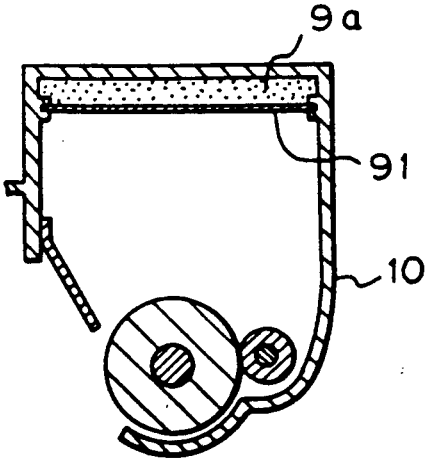
FIG. 17 is a section showing a developing device in which spare toner is stored.

As regards the life of the developing device 8, a near-end sense signal may be produced before the unit life sense signal. As shown in FIG. 17, in response to the near-end sense signal, a partition 91 provided in an upper portion of the developing casing 10 is manually pulled out to drop spare toner **9*a* into the casing 10**. This allows the copier to operate with the spare toner until the unit life sense signal appears. Such a construction is advantageous in that even if a new image forming unit is not near at hand, the copying cycle can be repeated with the spare toner till the delivery of a new unit.

While the foregoing description has concentrated on an image carrier which is implemented by a photoconductive drum, the drum may of course be replaced with a photoconductive belt, a dielectric drum or belt, etc.

In the illustrative embodiment, mainly the developing device and the cleaning device are constructed into an image forming unit which is removable from the copier body. Alternatively, the image forming unit may be constituted by only one of those various process means including the developing and cleaning devices. For example, the image forming unit may be constituted by the developing device only, the cleaning device only, the charging device only, or the transferring device only, or two or more of such devices. In this case, too, unit life sensor means and display means may be provided as previously stated.

A plurality of image forming units may be used, if desired. Then, an arrangement may be made such that when the life of any of the image forming units expires before the life of the image carrier, the display means is actuated to urge a person to replace that image forming unit; when the life of the drum expires, the display means is actuated to urge a person to replace the image carrier and particular one of the image forming units the life of which expires thereafter.

As described above, the first embodiment of the present invention is capable of reducing the frequency of replacement of an image carrier and an image forming unit by preventing the image carrier from being wastefully discarded before its life expires.

SECOND EMBODIMENT

Figure 18:
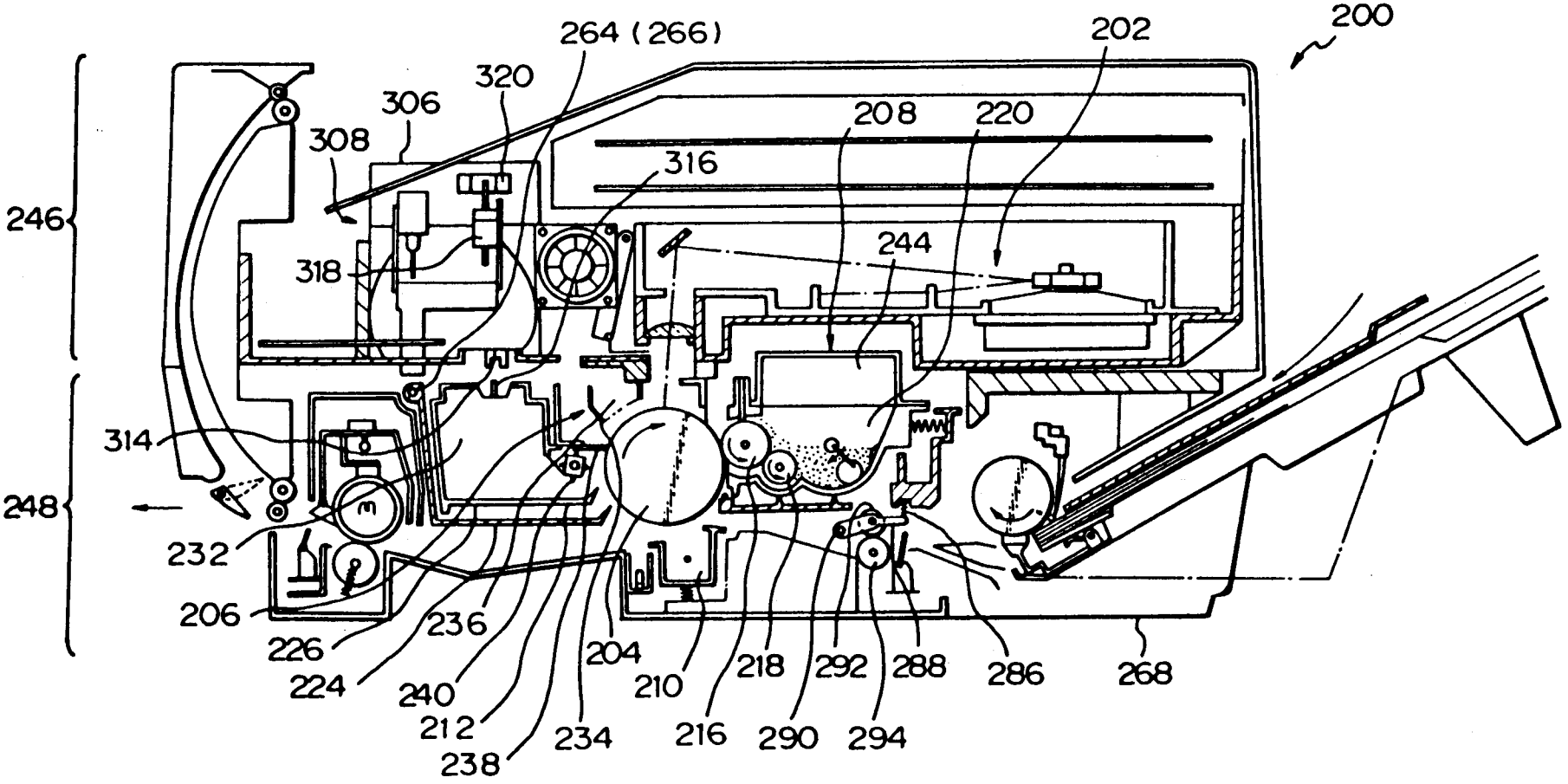
FIG. 18 is a section showing a laser printer which is representative of a second embodiment of the present invention.

A second embodiment of the present invention which will be described is applied to a laser printer. As shown in FIG. 18, a laser printer 200 includes laser optics 202 adapted to expose a photoconductive element 204 imagewise. In this embodiment, the photoconductive element 204 is also implemented by a drum. Arranged around the drum 204 is a charger 206, a developing device 208, a transfer charger 210, and a cleaning device 212. The drum 204, charger 206 and cleaning device 212 are joined together to constitute a drum unit 214. In the developing device 208, a developing roller 216, a toner supply roller 218 and a developer tank 220 are constructed into a developing unit 222. The drum unit 214 and the developing unit 222 are removably supported by an image forming unit casing 224 independently of each other.

The drum unit 214 includes a box-like casing 226 to which shafts 228 of the drum 204 are rotataly and removably supported. The casing 226 is formed with an opening 230 to which a laser beam from the optics 202 becomes incident. The casing 226 defines a toner collecting tank 232 of the cleaning device 212, FIG. 18, and is provided with a casing 234 of the charger 206, i.e. a wall which surrounds a charge wire 236. A cleaning blade 238 and a toner collecting roller 240 which constitute the cleaning device 212 are supported by the casing 226. The drum 204 is designed removable from the casing 226 and therefore from the toner collecting tank 232 for the following reason. Generally, when the toner collecting tank 232 becomes full of waste toner, it is replaced with a new tank. At this instant, if the drum 204 and the toner collecting tank 232 are unseparable from each other, the drum 204 has to be replaced together with the tank 232. In view of the fact that a photoconductive element has recently achieved a remarkably long life due to improvements in material, manufacturing process, etc, as previously stated, a photoconductive element cannot be used till the end of its life unless accompanied by a considerably large toner collecting tank and thereby a bulky printer construction. In the illustrative embodiment, the toner collecting tank 232 is used with the drum 204 in such a manner as to be replaceable with a new tank, promoting miniaturization of a printer and the effective use of a photoconductive element.

The developing unit 222 includes a casing 242 which defines the developer tank 220, FIG. 18. The developing roller 216 and toner supply roller 218 are rotatably supported by the casing 242. A toner cartridge 244 is removably mounted on the casing 242. When the amount of toner remaining in the developer tank 220 becomes short, the cartridge 244 is replaced with another to supply toner into the tank 220.

When the printer is constituted by an upper assembly 246 and a lower assembly 248, the image forming unit casing 224 is disposed in the lower assembly 248. Hence, the drum unit 214 and developing unit 222 are positioned in the lower assembly 248. In this construction, when the lower assembly 246 is raised, the drum unit 214 and developing unit 222 are exposed to the outside.

Figure 19:
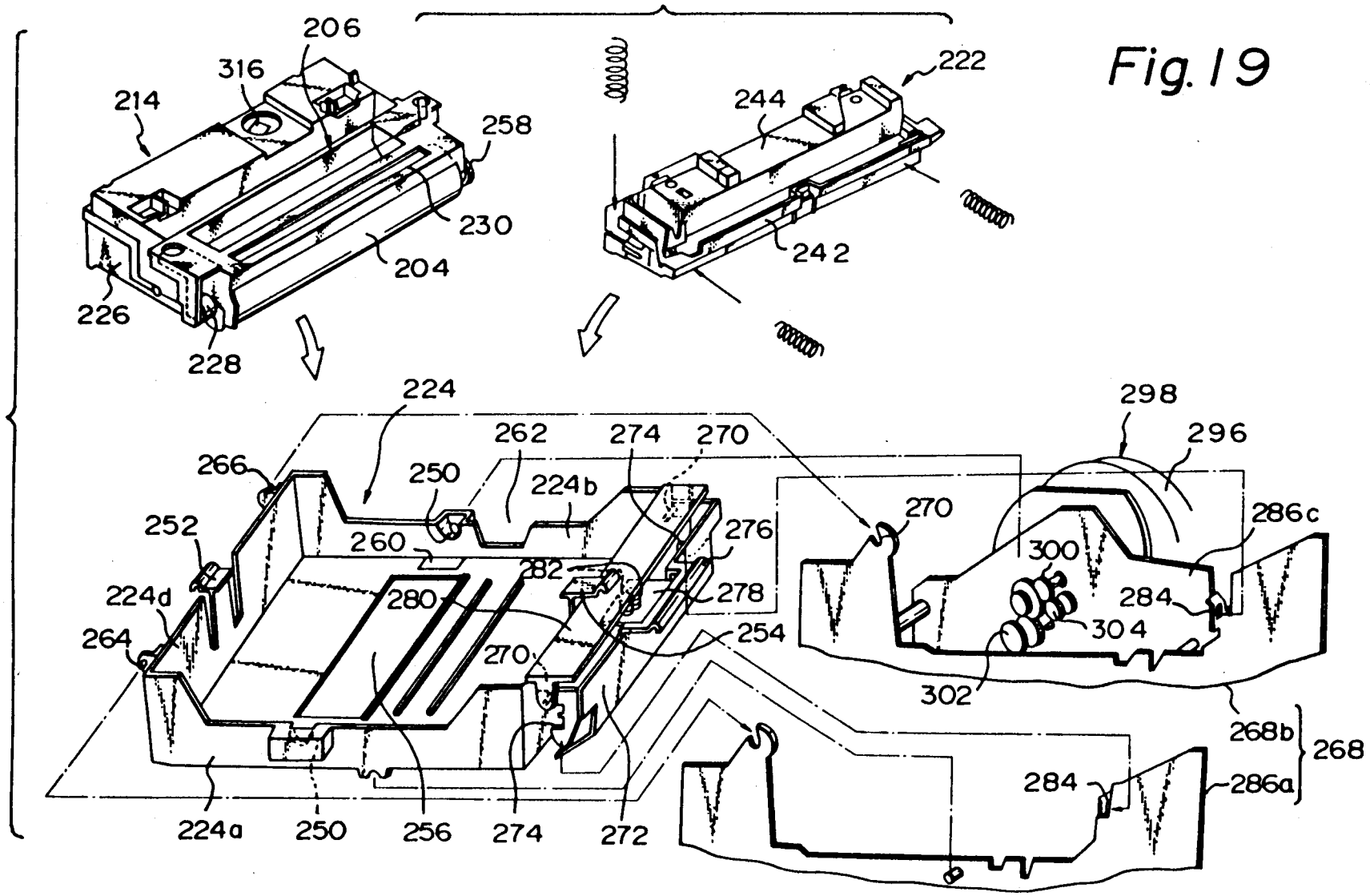
FIG. 19 is a fragmentary exploded view of the printer of FIG. 18.

As shown in FIG. 19, the image forming unit casing 224 is configured as a top-open box which includes a front wall **224*a* and a rear wall 224*b*. The walls 224*a* and 224*b* are individually provided with recessed support members 250 for supporting the shafts 228 of the drum 204. The drum unit 214 supported by the support members 250 are urged by a stop pawl 252. Likewise, the developing unit 222 is urged by a stop pawl 254 when received in the image forming unit casing 224. Made of a resilient material, the stop pawls 252 and 254 are individually deformable outward when their associated units 214 and 222 are loaded in the image forming casing 224** so as not to interfere with them.

The image forming unit 224 is provided with a comparatively large slot 256 and a comparatively small slot 260 through its bottom wall. When the drum unit 214 is loaded in the casing 224, a lower part of the drum 204 is received in the slot 256 while a gear 258 mounted on the drum support shaft 228 is received in the slot 260. A gear, not shown, is mounted on the end of a shaft of the developing roller 216 such that when the developing unit 222 is loaded in the casing 224, the gear protudes to the outside through a recess 262 which is provided in the rear wall **224*b* of the casing 224**.

Pins 264 and 266 are studded on a left wall **224*d* of the image forming unit casing 224 and individually mated with notches 270 which are provided in opposite side walls 268*a* and 268*b* of a frame 268 of the lower assembly 248. The image forming unit casing 224, therefore, can be rotated upward about the pins 264 and 266 while accommodating the drum unit 214 and developing unit thereinside. As shown in FIG. 18, a paper transport path is defined below the casing 224. This paper transport path is uncovered when the casing 224 is raised as stated above so that a paper which may jam the path is removable with ease. The image forming unit casing 224 may be bodily removed from the lower assembly 248** as needed.

As shown in FIG. 19, a pair of pins 270 are studded on the right end of the image forming unit casing 224 while a member 272 is rotatably mounted on the pins 270. The rotatable member 272 is provided with a pair of lock pawls 274 and a handle 276. The member 272 is partly cut and bent to define a spring seat 278. Compression springs 282 are preloaded between the spring seat 278 and a horizontal portion 280 which is provided at the right end of the casing 224, so that the rotatable member 272 is constantly biased about the pins 270 toward the casing 224.

Lower frame side walls 268*a* and 268*b* are each formed with an opening 284. When the image forming unit casing 224 is mounted in a predetermined position as shown in FIG. 18, the lock pawls 274 are individually urged into the openings 284 by the action of the springs 282. As shown in FIG. 18, a compression spring 286 is disposed below the right end of the casing 224 with its lower end abutting against a lever 288. Hence, when the casing 224 is positioned as shown in FIG. 18, the casing 224 is urged counterclockwise by the spring 286 about the pins 264 and 266 with the result that the lock pawls 274 are caused to abut against the upper surface of the openings 284 to positively lock the casing 224 in position.

The lever 288 is rotatably supported by a lower frame 268 via a pin 290 and in turn rotatably support an upper transport roller 292 which is adapted to transport a paper. As the image forming unit casing 224 is positioned as shown in FIG. 18, the spring 286 urges the lever 288, as previously stated so that the upper transport roller 292 is pressed agains a lower transport roller 294.

Another frame side plate 268*c* is fixed to the rear lower frame side plate 268*b* while a main motor unit 298 having a main motor 296 is mounted on the frame side plate 268*c*. A drive gear 300 is mounted on the output shaft of the main motor 296 and drivably connected to a drum drive gear 302 and a developing roller drive gear 304 by a suitable gear train. In the condition shown in FIG. 18, the gear 258 associated with the drum unit 214 and the gear, not shown, associated with the developing roller 216 are meshed with the drive gears 302 and 304, respectively. In this condition, the drum 204 and the developing roller 216 may be driven by the main motor 296.

Figure 20:
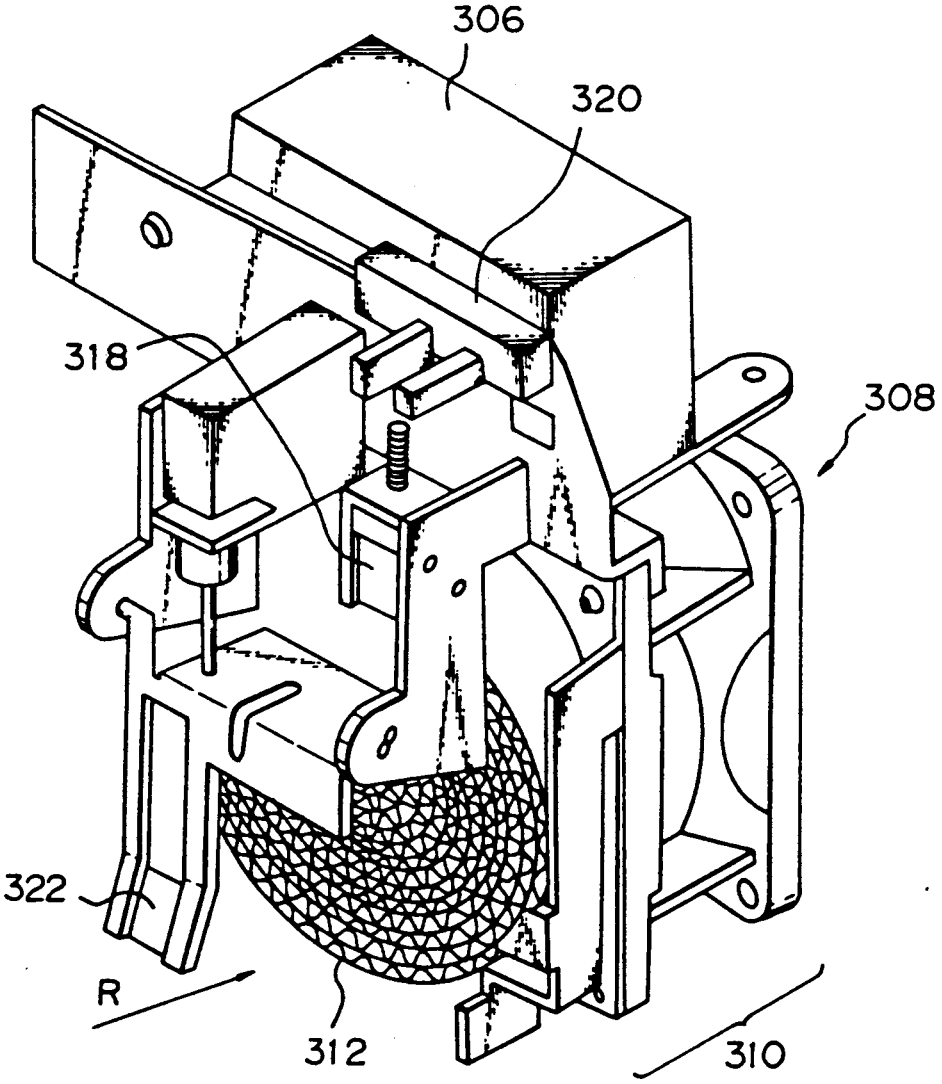
FIG. 20 is a perspective view of a particular portion in which an OPC counter is disposed.

An OPC counter 306 is located, for example, above a fan unit 308 which is in turn located obliquely above the charger 206 of the printer 200. The OPC counter 306 is sequentially incremented by transfer command signals from a main controller, not shown, so as to count the frequency of image forming operation. Every time the cleaning unit 212 which includes the toner collecting tank 232 and cleaning blade 238 is replaced, the OPC counter 306 is reset. FIG. 20 shows a specific arrangement of the OPC counter 306 and fan unit 308. In FIG. 20, the fan unit 308 is shown as comprising a suction fan 310 and an ozone filter 312. The OPC counter 306 delivers its output when it reaches a predetermined value which is associated with the life of the drum 204, e.g. 20,000.

As shown in FIG. 18, toner sensor means 314 responsive to a full condition of the toner collecting tank 232 is positioned above the tank 232. The toner sensor means 314 may be implemented with a feeler 316 which is raised by waste toner when the toner collecting tank 232 becomes full of the waste toner.

Figure 21:
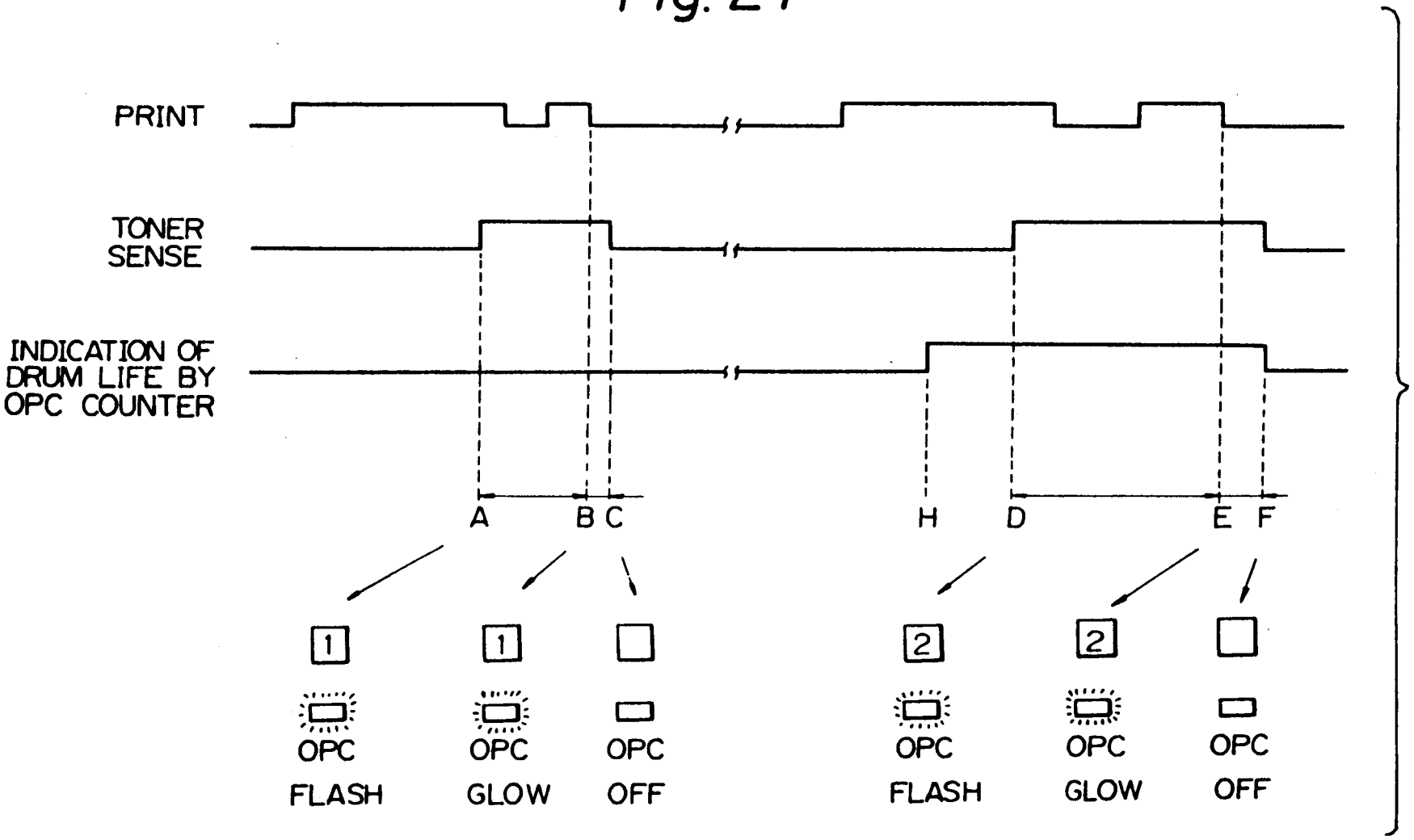
FIGS. 21 and 22 are timing charts demonstrating a procedure in which a cleaning unit and a photoconductive drum unit are replaced.

Referring to FIG. 21, how the cleaning unit and the drum unit are replaced is shown. When the toner sensor means 314 senses that the toner collecting tank 232 is full, its output is applied to the main controller. From the time when the full condition is sensed (time A shown in FIG. 21), the main controller activates a display section to display a symbol "1 (one)" which shows that only the cleaning unit should be replaced. At the same time, the main controller causes an OPC lamp to flash so as to alert a person to the full condition of the toner collecting tank 232 (i.e. toner over). Here, an arrangement is made such that the printing cycle can be further repeated a predetermined number of times after the detection of toner over condition, whereby the printer is prevented from becoming unoperable while printing out the same data on a plurality of papers. Even after the printing operation is interrupted before the printing cycle is repeated extra fifty times, it may be executed until the printing cycle reaches the predetermined frequency. When the fiftieth printing cycle is completed (time B in FIG. 21), the main controller switches the OPC lamp from the flash mode to a continuous glow mode while interrupting the printing operation. In this condition, the printer does not accept a further print command which may be delivered thereto from the main controller. Even when the power supply of the printer is turned off and then turned on, the main controller maintains the printer unable to print, displays the symbol "1", and continuously turns on the OPC lamp and continuously turns on the OPC lamp.

When the cleaning unit is replaced with another (time C in FIG. 21), the main controller cancels the disenabled state of the priner so that the symbol "1" disappears and the OPC lamp extinguishes. At the instant when the symbol "1" appears on the first display section and the OPC lamp is turned on, i.e., when the cleaning unit is full of waste toner, it is not necessary to replace the drum 204 because its life has not expired yet. Since the life of the drum 204 is predetermined to expire when the drum 204 is used 20,000 times by way of example, the drum 204 is not replaced when the toner over condition is reached for the first time. That is, the drum 204 is removed from the drum 214 so as to discard the cleaning unit 212 only.

Specifically, the drum 204 is loaded in a new drum unit 214 whose toner collecting tank 232 is empty and, then, the new drum unit 214 is mounted in the predetermined position of the lower assembly 248. Afterwards, when the OPC counter 306 is incremented to 20,000 by the repetition of printing cycle (time H of FIG. 21), the main controller displays a symbol "2" on the display section while causing the OPC lamp to flash (time D in FIG. 21) so as to indicate the need for the replacement of the drum unit 214. Again, the printing cycle may be further repeated a predetermined number of times such as fifty times after the display of the symbol "2". As the fiftieth printing cycle is completed, the main controller causes the OPC lamp to continuously glow while disenabling the printer (time E of FIG. 21).

When the OPC lamp is switched from the flash mode to the continuous glow mode with the symbol "2" appearing on the display, a latching solenoid 318, FIGS. 18 and 20, is energized to pull its plunger so that a latch sensor 320, FIGS. 18 and 20, is turned on. So long as the latch sensor 320 is turned on, the symbol "2" continuously appears on the display section urging a person to replace the drum unit. When a reset lever 322, FIG. 20, adapted to reset the OPC counter 306 is manually reset as indicated by an arrow R, the latch sensor 320 is turned off simultaneously with the OPC counter 306 (time F in FIG. 21). The symbol "2" indicates that the drum 204 has been used more than 20,000 times and should not be used any further. This urges a person to replace the whole drum unit 214 inclusive of the drum 204. After the replacement, as the operator presses the reset lever 322, the latch sensor 320 is initialized while, at the same time, the OPC counter 306 is reset. Then the OPC counter 306 starts counting from zero again. Even after the drum unit 214 has been replaced, the latch sensor 320 is not initialized and therefore the symbol "2" on the display section does not disappear unless the reset lever 322 is pressed. In this manner, the latch sensor 320 prevents a person from carelessly forgetting to reset the OPC counter 306 after the replacement.

Figure 22:
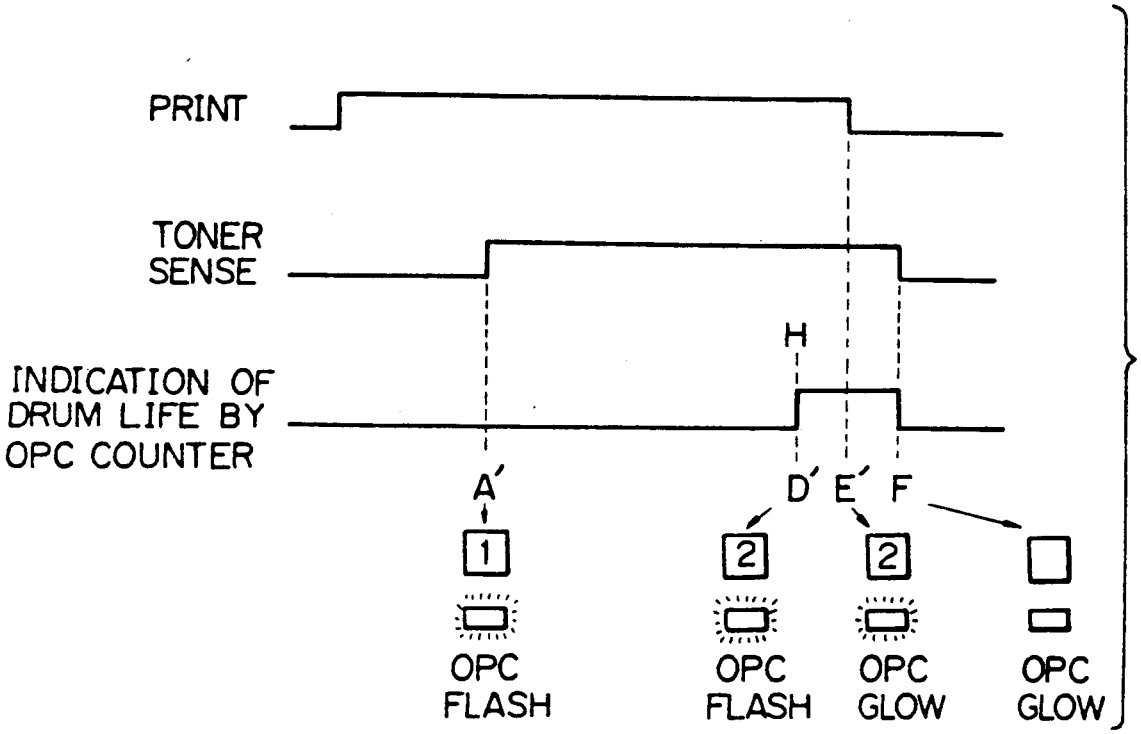

As the toner sensor means 314 of the cleaning unit senses the full condition of the cleaning unit when the life of the drum 204 is about to expire, the main controller displays the symbol "1" on the display section (time A') as shown in FIG. 22 while causing the OPC lamp to flash. As soon as the OPC counter 306 reaches 20,000, the symbol "2" is substituted for the symbol "2" while the OPC lamp is maintained in the flash mode (times H and D' which are coincident). When extra fifty is reached, the OPC lamp is switched from the flash mode to the continuous glow mode with the symbol "2" maintained on the display section (time E'). This disenables the printer. When the drum unit is replaced and then the reset lever is pressed, both the symbol on the display section and the OPC lamp are turned off. Then, the OPC counter 306 starts counting from zero.

When the power supply of the printer is turned off and then turned on while the symbol "1" associated with the cleaning unit or the symbol "2" associated with the drum unit is appearing and the OPC lamp is flashing, the printer is held in the disenabled state and not in the standby state until the reset lever is pressed after the replacement of the cleaning unit or the drum unit. It may occur that, depending upon the volume of the toner collecting tank, the replacement of the cleaning unit alone occurs more than once before the drum unit is replaced.

Figure 23:
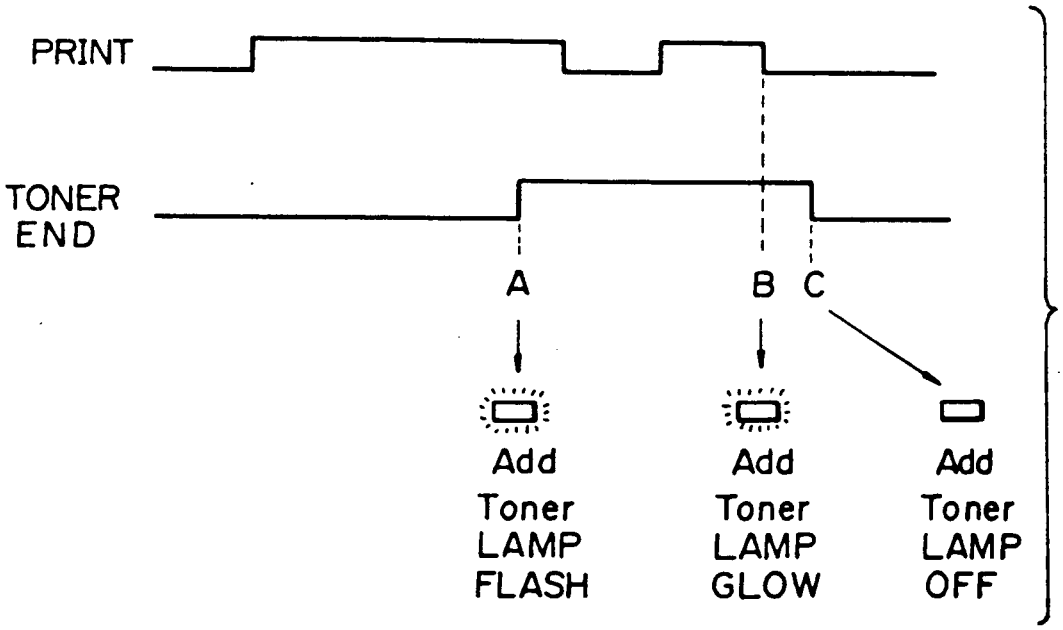
FIG. 23 is a timing chart demonstrating a procedure in which a developing unit is replaced.

As shown in FIG. 23, when a toner end sensor, not shown, which is included in the developing unit 222 senses the shortage of toner (toner end) while a printing operation is under way, a toner end lamp is caused to flash alerting a person to such a condition (time A). Again, the printing cycle may be repeated, for example, extra fifty times after the detection of toner end for the previously stated reason. When the extra fifty times of copying cycle is completed, the toner end lamp is switched from the flash mode to a continuous glow mode while, at the same time, the printer is disenabled (time B). This condition of the printer will be cancelled when the toner cartridge is replaced to supply toner (time C).

When the power supply of the printer is turned off and then turned on while the toner end lamp is flashing or glowing, the printer is disenabled after the turn-on of the power supply.

As described above, the second embodiment of the present invention allows a cleaning unit and a drum to be used until their lives which are different from each other expire and therefore with considerable efficiency.

Various modifications will become possible for those skilled in the art after receiving the teachings of the present disclosure without departing from the scope thereof.

What is claimed is:

1. An image forming apparatus including a body, an image carrier removably mounted on said body for carrying an electrostatic latent image thereon, and a plurality of process means for developing the latent image provided on said image carrier to produce a visible image, transferring the visible image to a transfer material, and cleaning said image carrier after the visible image has been transferred, said apparatus comprising:

at least one image forming unit having at least one of said process means and removably mounted on said body;

first sensor means for sensing the end of the life of said image forming unit;

second sensor means for sensing the end of the life of said image carrier;

first display means for urging a person to replace said image forming unit when said first sensor means senses the end of the life of said image forming unit; and second display means for urging a person to replace said image forming unit and said image carrier when said first sensor means senses the end of the life of said image forming unit after said second sensor means has sensed the end of the life of image carrier.

2. An apparatus as claimed in claim 1, wherein said image carrier comprises a photoconductive element.

3. An apparatus as claimed in claim 1, wherein said image carrier comprises a dielectric element.

4. An apparatus as claimed in claim 1, wherein said process means comprise a charging device, an exposing device, a developing device, a transferring device, a cleaning device, and a discharging device.

5. An image forming apparatus including a body, an image carrier removably mounted on said body for carrying an electrostatic latent image thereon, and a plurality of process means for developing the latent image provided on said image carrier to produce a visible image, transferring the visible image to a transfer material, and cleaning said image carrier after the visible image has been transferred, said apparatus comprising:

at least one image forming unit having at least one of said process means and removably mounted on said body;

first sensor means for sensing the end of the life of said image forming unit;

second sensor means for sensing the end of the life of said image carrier;

first display means for urging a person to replace said image forming unit and said image carrier when said first sensor means senses the end of the life of said image forming unit after said second sensor means has sensed the life of said image carrier within a predetermined range of frequency of image forming;

second display means for urging a person to replace said image carrier after the image forming cycle has been repeated the predetermined number of times, when said first sensor means does not sense the life of said image forming unit within the predetermined range of frequency of image forming; and third display means for urging a person to replace said image forming unit when said first sensor means senses the end of the life of said image forming unit at the outside of the predetermined range of frequency of image forming.

6. An apparatus as claimed in claim 5, wherein said image carrier comprises a photoconductive element.

7. An apparatus as claimed in claim 5, wherein said image carrier comprises a dielectric element.

8. An apparatus as claimed in claim 5, wherein said process means comprise a charging device, an exposing device, a developing device, a transferring device, a cleaning device, and a discharging device.

9. An image forming apparatus comprising:

image forming means including a photoconductive element, a cleaning unit, and a developing unit;

counter means for counting image forming cycles which are sequentially executed with said photoconductive element;

toner sensor means for producing an output which is representative of a full condition of said cleaning unit; and control means electrically connected to said counter means and said toner sensor means for controlling said image forming means such that, when said toner sensor means senses the full condition, an indication for urging a person to replace said cleaning unit is displayed and, when said counter counts a predetermined number of image forming cycles after said toner sensor means has sensed the full condition, the image forming operation is interrupted; and when said toner sensor means senses the full condition while, at the same time, said counter means counts a predetermined number of image forming cycles which is representative of the end of the life of said photoconductive element, an indication for urging a person to replace said photoconductive element and said cleaning unit is displayed and, when said counter counts the predetermined number of image forming cycles after said toner sensor means has sensed the full condition, the image forming operation is interrupted.

* * * * *